US008028491B2

(12) United States Patent
Flaherty et al.

(10) Patent No.: US 8,028,491 B2
(45) **Date of Patent: *Oct. 4, 2011**

(54) REPLACEABLE WET-SET TACTILE WARNING SURFACE UNIT AND METHOD OF INSTALLATION AND REPLACEMENT

(75) Inventors: John P. Flaherty, Woburn, MA (US); William Scott Ober, Hopkinton, MA (US)

(73) Assignee: ADA Solutions, Inc., Chelmsford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/849,564

(22) Filed: Aug. 3, 2010

(65) Prior Publication Data

US 2010/0313502 A1 Dec. 16, 2010

Related U.S. Application Data

(63) Continuation of application No. 12/115,595, filed on May 6, 2008, now Pat. No. 7,779,581.

(60) Provisional application No. 60/916,887, filed on May 9, 2007, provisional application No. 61/014,361, filed on Dec. 17, 2007.

(51) Int. Cl.
*E04B 1/00* (2006.01)

(52) U.S. Cl. ..... 52/747.11; 52/177; 52/514; 404/19; 116/205

(58) Field of Classification Search ..... 52/33, 174–177, 52/179, 180, 181, 514, 514.5, 746.1, 747.1, 52/747.11; 404/12–16, 19, 34–43, 73, 75; 116/205

See application file for complete search history.

(56) References Cited

U.S. PATENT DOCUMENTS

| | | | | |
|---|---|---|---|---|
| 2,032,532 | A | 3/1936 | Eck | |
| 2,070,984 | A | 2/1937 | Collins | |
| 4,080,087 | A | 3/1978 | Phillips | |
| 4,380,996 | A | 4/1983 | Mengeringhausen | |
| 4,674,251 | A * | 6/1987 | Wolff | 52/309.15 |

(Continued)

FOREIGN PATENT DOCUMENTS

AU 21483/35 2/1935

(Continued)

OTHER PUBLICATIONS

*Engineering Plastics, Inc.* v. *ADA Solutions, Inc.*—Civil Action No. 09-04547 (S.D.N.Y)—Document 15, filed Jul. 24, 2009, Defendant's First Amended Answer, Affirmative Defenses, Counterclaims and Demand for Jury Trial (22-Pages).

(Continued)

*Primary Examiner* — William Gilbert

(74) *Attorney, Agent, or Firm* — Nields, Lemack & Frame, LLC

(57) ABSTRACT

A replaceable, wet-set tactile warning surface unit having a body defining an upper surface and a lower surface, the body defining a series of raised projections on its upper surface, and defining a plurality of spaced through-holes from the top to the bottom surface, in which the raised projections are spaced from one another and the through-holes are located between projections. An anchor member such as a threaded insert is coupled to the bottom surface of the unit member directly below each of the through-holes by fasteners such as bolts that pass through the through-holes.

13 Claims, 18 Drawing Sheets

U.S. PATENT DOCUMENTS

| | | | | |
|---|---|---|---|---|
| 4,715,743 | A | 12/1987 | Schmanski | |
| 5,217,319 | A | 6/1993 | Klohn | |
| 5,271,690 | A | 12/1993 | Fennessy, Sr. | |
| 5,302,049 | A | 4/1994 | Schmanski | |
| 5,303,669 | A | 4/1994 | Szekely | |
| 5,320,790 | A | 6/1994 | Lowe | |
| 5,328,293 | A | 7/1994 | Keefe | |
| 5,386,782 | A | 2/1995 | Dinis et al. | |
| 5,526,766 | A | 6/1996 | Armstrong et al. | |
| 5,616,650 | A | 4/1997 | Becker et al. | |
| 5,637,641 | A | 6/1997 | Becker et al. | |
| 5,733,997 | A | 3/1998 | Becker et al. | |
| 5,741,878 | A | 4/1998 | Becker et al. | |
| 5,750,628 | A | 5/1998 | Becker et al. | |
| 5,755,527 | A | 5/1998 | Dufresne | |
| 5,767,218 | A | 6/1998 | Becker et al. | |
| 5,775,835 | A | 7/1998 | Szekely | |
| 5,807,954 | A | 9/1998 | Becker et al. | |
| 5,827,009 | A | 10/1998 | Kokoletsos | |
| 5,838,238 | A | 11/1998 | Abita et al. | |
| 5,840,396 | A | 11/1998 | Betz | |
| 5,845,580 | A | 12/1998 | Muller et al. | |
| 5,927,034 | A | 7/1999 | Cole | |
| 5,933,082 | A | 8/1999 | Abita et al. | |
| 6,153,282 | A | 11/2000 | Dickinson et al. | |
| 6,153,828 | A | 11/2000 | Murata et al. | |
| 6,173,653 | B1 | 1/2001 | Edelmann | |
| 6,273,657 | B1 | 8/2001 | Vorona | |
| 6,449,790 | B1 | 9/2002 | Szekely | |
| 6,450,728 | B1 | 9/2002 | Grahmbeek et al. | |
| 6,453,630 | B1 * | 9/2002 | Buhrts et al. | 52/177 |
| 6,485,226 | B1 | 11/2002 | Harger | |
| 6,488,618 | B1 | 12/2002 | Paolitto et al. | |
| 6,499,910 | B1 | 12/2002 | Grahmbeek et al. | |
| 6,709,191 | B1 | 3/2004 | McCuskey | |
| 6,718,714 | B1 | 4/2004 | Montgomery, Sr. | |
| 6,802,159 | B1 | 10/2004 | Kotler | |
| 6,890,124 | B2 | 5/2005 | Provenzano, III | |
| 6,895,622 | B2 | 5/2005 | Szekely | |
| 6,939,078 | B1 | 9/2005 | Anderson et al. | |
| 6,951,435 | B1 | 10/2005 | Fennessy, Sr. | |
| 6,951,436 | B2 | 10/2005 | Stegemeier et al. | |
| 6,960,989 | B1 | 11/2005 | Grayson | |
| 6,964,244 | B2 | 11/2005 | Stockton | |
| 6,971,818 | B1 | 12/2005 | Schabacker | |
| 7,000,279 | B2 | 2/2006 | Szekely | |
| 7,000,361 | B1 | 2/2006 | Merriman et al. | |
| 7,001,103 | B2 | 2/2006 | Sippola | |
| 7,114,298 | B2 * | 10/2006 | Kotler | 52/177 |
| 7,121,048 | B1 | 10/2006 | Merriman et al. | |
| 7,142,095 | B1 | 11/2006 | Grayson | |
| 7,182,548 | B1 | 2/2007 | Womack | |
| 7,189,025 | B1 | 3/2007 | Greer et al. | |
| 7,223,048 | B1 | 5/2007 | Greer et al. | |
| 7,249,911 | B2 | 7/2007 | Hyams | |
| 7,267,281 | B2 | 9/2007 | Hopkins | |
| 7,674,066 | B2 * | 3/2010 | Wehmeyer | 404/19 |
| 7,779,581 | B2 | 8/2010 | Flaherty et al. | |
| 2002/0149570 | A1 | 10/2002 | Knowles et al. | |
| 2003/0037720 | A1 | 2/2003 | Stockton | |
| 2003/0084523 | A1 | 5/2003 | Szekely | |
| 2004/0042850 | A1 | 3/2004 | Provenzano, III | |
| 2004/0067336 | A1 | 4/2004 | Munroe, II | |
| 2005/0013662 | A1 | 1/2005 | Provenzano et al. | |
| 2005/0031415 | A1 | 2/2005 | Sippola | |
| 2005/0066623 | A1 | 3/2005 | Sippola | |
| 2005/0144743 | A1 | 7/2005 | Szekely | |
| 2005/0265782 | A1 | 12/2005 | Everett | |
| 2006/0024132 | A1 | 2/2006 | Seman | |
| 2006/0037155 | A1 | 2/2006 | Szekely | |
| 2006/0039752 | A1 | 2/2006 | Hyams | |
| 2006/0108426 | A1 | 5/2006 | Hopkins | |
| 2006/0174567 | A1 | 8/2006 | Sippola | |
| 2006/0188680 | A1 | 8/2006 | Everett | |
| 2006/0210766 | A1 | 9/2006 | Press et al. | |
| 2006/0227009 | A1 | 10/2006 | Koehn | |
| 2006/0245827 | A1 * | 11/2006 | Rydin et al. | 404/9 |
| 2007/0028531 | A1 | 2/2007 | Woodcock | |
| 2007/0059441 | A1 | 3/2007 | Greer | |
| 2007/0086859 | A1 | 4/2007 | Julnes | |
| 2007/0092335 | A1 * | 4/2007 | Wehmeyer | 404/19 |
| 2007/0092355 | A1 | 4/2007 | Burger et al. | |
| 2007/0196169 | A1 | 8/2007 | Logan et al. | |
| 2007/0201949 | A1 | 8/2007 | Veldboom et al. | |
| 2007/0269264 | A1 | 11/2007 | Boghossian | |

FOREIGN PATENT DOCUMENTS

| | | |
|---|---|---|
| CA | 2070984 | 6/1992 |
| CA | 2032532 | 5/1994 |
| CA | 2092367 | 9/1994 |
| EP | 0425901 A1 | 5/1991 |
| GB | 379690 | 8/1932 |
| GB | 433732 | 8/1935 |
| GB | 486128 | 5/1938 |

OTHER PUBLICATIONS

*Engineering Plastics, Inc.* v. *ADA Solutions, Inc.*—Civil Action No. 09-04547 (S.D.N.Y)—Document 16, Filed Aug. 5, 32009, Plaintiffs' Answer and Affirmative Defenses to Defendants' Counterclaims (8-Pages).

*Engineering Plastics, Inc.* v. *ADA Solutions, Inc.*—Civil Action No. 09-04547 (S.D.N.Y)—Document 18, Filed Aug. 11, 2009, Preliminary Pre-Trial Statement (19-Pages).

*Engineering Plastics, Inc.* v. *ADA Solutions, Inc.*—Civil Action No. 09-04547 (S.D.N.Y)—Document 20, Filed Aug. 14, 2009, Pre-Trial Scheduling Order (6-Pages).

*Engineering Plastics, Inc.* v. *ADA Solutions, Inc.*—Civil Action No. 09-04547 (S.D.N.Y)—Document 28, Filed Dec. 1, 2009, Order of Discontinuance (1-Page).

*Engineering Plastics, Inc.* v. *ADA Solutions, Inc.*—Civil Action No. 09-04547 (S.D.N.Y)—Document 1, Filed May 13, 2009, Complaint Jury Trial Demand (16-Pages).

*Engineering Plastics, Inc.* v. *ADA Solutions, Inc.*—Civil Action No. 09-04547 (S.D.N.Y)—Document 14, Filed Jul. 7, 2009, Defendants's Answer, Affirmative Defenses, Counterclaims and Demand for Jury Trial (22-Pages).

*ADA Solutions, Inc.* v. *Engineering Plastics, Inc.*—Civil Action No. 10-11512-NMG (D.Mass)—Document 1, Filed Sep. 3, 2010, Complaint (5-Pages).

*ADA Solutions, Inc.* v. *Engineering Plastics, Inc.*—Civil Action No. 10-11512-NMG (D.Mass)—Document 1-1 of Complaint, Filed Sep. 3, 2010, Report on the Filing or Determination of an Action Regarding a Patent or Trademark (1-Page).

*ADA Solutions, Inc.* v. *Engineering Plastics, Inc.*—Civil Action No. 10-11512-NMG (D.Mass)—Document 1-2 of Complaint, Filed Sep. 3, 2010, United States District Court District of Massachusetts CategoryForm-08) (1-Page).

*ADA Solutions, Inc.* v. *Engineering Plastics, Inc.*—Civil Action No. 10-11512-NMG (D.Mass)—Document 1-3 of Complaint, Filed Sep. 3, 2010, Civil Cover Sheet (2-Pages).

*ADA Solutions, Inc.* v. *Engineering Plastics, Inc.*—Civil Action No. 10-11512-NMG (D.Mass)—Document 1-4 of Complaint, Filed Sep. 3, 2010, US Patent No. 7,779,581 (Flaherty et al. —Issued Aug. 24, 2010).

*ADA Solutions, Inc.* v. *Engineering Plastics, Inc.*—Civil Action No. 10-11512-NMG (D.Mass)—Document 11, Filed Oct. 18, 2011, Answer and Counterclaims of Defendants Engineered Plastics, Inc. and Access Products Inc. (29-Pages).

*ADA Solutions, Inc.* v. *Engineering Plastics, Inc.*—Civil Action No. 10-11512-NMG (D.Mass)—Document 11-1, Filed Oct. 18, 2011, Answer and Counterclaims of Defendants Engineered Plastics, Inc. and Access Products Inc.—Exhibit 1 (2-Pages).

*ADA Solutions, Inc.* v. *Engineering Plastics, Inc.*—Civil Action No. 10-11512-NMG (D.Mass)—Document 11-2, Filed Oct. 18, 2011, Answer and Counterclaims of Defendants Engineered Plastics, Inc. and Access Products Inc.—Exhibit 2 (5-Pages).

*ADA Solutions, Inc.* v. *Engineering Plastics, Inc.*—Civil Action No. 10-11512-NMG (D.Mass)—Document 11-3, Filed Oct. 18, 2011, Answer and Counterclaims of Defendants Engineered Plastics, Inc. and Access Products Inc.—Exhibit 3 (6-Pages).

*ADA Solutions, Inc.* v. *Engineering Plastics, Inc.*—Civil Action No. 10-11512-NMG (D.Mass)—Document 11-4, Filed Oct. 18, 2011, Answer and Counterclaims of Defendants Engineered Plastics, Inc. and Access Products Inc.—Exhibit 4 (29-Pages).
*ADA Solutions, Inc.* v. *Engineering Plastics, Inc.*—Civil Action No. 10-11512-NMG (D.Mass)—Document 11-5, Filed Oct. 18, 2011, Answer and Counterclaims of Defendants Engineered Plastics, Inc. and Access Products Inc.—Exhibit 5 (2-Pages).
*ADA Solutions, Inc.* v. *Engineering Plastics, Inc.*—Civil Action No. 10-11512-NMG (D.Mass)—Document 11-6, Filed Oct. 18, 2011, Answer and Counterclaims of Defendants Engineered Plastics, Inc. and Access Products Inc.—Exhibit 6 (2-Pages).
*ADA Solutions, Inc.* v. *Engineering Plastics, Inc.*—Civil Action No. 10-11512-NMG (D.Mass)—Document 11-7, Filed Oct. 18, 2011, Answer and Counterclaims of Defendants Engineered Plastics, Inc. and Access Products Inc.— Exhibit 7 (2-Pages).
*ADA Solutions, Inc.* v. *Engineering Plastics, Inc.*—Civil Action No. 10-11512-NMG (D.Mass)—Document 13, Filed Nov. 3, 2010, First Amended Answer and Counterclaim of Defendants Engineered Plastics, Inc. and Access Products, Inc. (30-Pages).
*ADA Solutions, Inc.* v. *Engineering Plastics, Inc.*—Civil Action No. 10-11512-NMG (D.Mass)—Document 13-1, Filed Nov. 3, 2010, First Amended Answer and Counterclaim of Defendants Engineered Plastics, Inc. and Access Products, Inc.—Exhibit 1 (2-Pages).
*ADA Solutions, Inc.* v. *Engineering Plastics, Inc.*— Civil Action No. 10-11512-NMG (D.Mass)—Document 13-2, Filed Nov. 13, 2010, First Amended Answer and Counterclaim of Defendants Engineered Plastics, Inc. and Access Products, Inc.—Exhibit 2 (5-Pages).
*ADA Solutions, Inc.* v. *Engineering Plastics, Inc.*— Civil Action No. 10-11512-NMG (D.Mass)—Document 13-3, Filed Nov. 3, 2010, First Amended Answer and Counterclaim of Defendants Engineered Plastics, Inc. and Access Products, Inc.—Exhibit 3 (7-Pages).
*ADA Solutions, Inc.* v. *Engineering Plastics, Inc.*— Civil Action No. 10-11512-NMG (D.Mass)—Document 13-4, Filed Nov. 3, 2010, First Amended Answer and Counterclaim of Defendants Engineered Plastics, Inc. and Access Products, Inc.—Exhibit 4 (29-Pages).
*ADA Solutions, Inc.* v. *Engineering Plastics, Inc.*— Civil Action No. 10-11512-NMG (D.Mass)—Document 13-5, Filed Nov. 3, 2010, First Amended Answer and Counterclaim of Defendants Engineered Plastics, Inc. and Access Products, Inc.—Exhibit 5 (2-Pages).
*ADA Solutions, Inc.* v. *Engineering Plastics, Inc.*— Civil Action No. 10-11512-NMG (D.Mass)—Document 13-6, Filed Nov. 3, 2010, First Amended Answer and Counterclaim of Defendants Engineered Plastics, Inc. and Access Products, Inc.—Exhibit 6 (2-Pages).
*ADA Solutions, Inc.* v. *Engineering Plastics, Inc.*— Civil Action No. 10-11512-NMG (D.Mass)—Document 13-7, Filed Nov. 3, 2010, First Amended Answer and Counterclaim of Defendants Engineered Plastics, Inc. and Access Products, Inc.—Exhibit 7 (2-Pages).
*ADA Solutions, Inc.* v. *Engineering Plastics, Inc.*— Civil Action No. 10-11512-NMG (D.Mass)—Document 14, Filed Nov. 17, 2010, Answer to Counterclaim (20-Pages).
*ADA Solutions, Inc.* v. *Engineering Plastics, Inc.*— Civil Action No. 10-11512-NMG (D.Mass)—Document 16, Filed Dec. 16, 2010, First Amended Answer to Counterclaims (21-Pages).
*ADA Solutions, Inc.* v. *Engineering Plastics, Inc.*— Civil Action No. 10-11512-NMG (D.Mass)—Document 17, Filed Dec. 17, 2010, Second Amended Answer and Counterclaim of Defendants Engineered Plastics, Inc. and Access Products, Inc. (30-Pages).
*ADA Solutions, Inc.* v. *Engineering Plastics, Inc.*— Civil Action No. 10-11512-NMG (D.Mass)—Document 17-1, Filed Dec. 17, 2010, Second Amended Answer and Counterclaim of Defendants Engineered Plastics, Inc. and Access Products, Inc.—Exhibit 1 (2-Pages).
*ADA Solutions, In.* v. *Engineering Plastics, Inc.*— Civil Action No. 10-11512-NMG (D.Mass)—Document 17-2, Filed Dec. 17, 2010, Second Amended Answer and Counterclaim of Defendants Engineered Plastics, Inc. and Access Products, Inc.—Exhibit 2 (5-Pages).
*ADA Solutions, Inc.* v. *Engineering Plastics, Inc.*—Civil Action No. 10-11512-NMG (D.Mass)—Document 17-3, Filed Dec. 17, 2010, Second Amended Answer and Counterclaim of Defendants Engineered Plastics, Inc. and Access Products, Inc. —Exhibit 3 (7-pages).
*ADA Solutions, Inc.* v. *Engineering Plastics, Inc.*—Civil Action No. 10-11512-NMG (D.Mass)—Document 17-4, Filed Dec. 17, 2010, Second Amended Answer and Counterclaim of Defendants Engineered Plastics, Inc. and Access Products, Inc.—Exhibit 4 (29-Pages).
*ADA Solutions, Inc.* v. *Engineering Plastics, Inc.*—Civil Action No. 10-11512-NMG (D.Mass)—Document 17-5, Filed Dec. 17, 2010, Second Amended Answer and Counterclaim of Defendants Engineered Plastics, Inc. and Access Products, Inc.—Exhibit 5 (2-Pages).
*ADA Solutions, Inc.* v. *Engineering Plastics, Inc.*—Civil Action No. 10-11512-NMG (D.Mass)—Document 17-6, Filed Dec. 17, 2010, Second Amended Answer and Counterclaim of Defendants Engineered Plastics, Inc. and Access Products, Inc.—Exhibit 6 (2-Pages).
*ADA Solutions, Inc.* v. *Engineering Plastics, Inc.*—Civil Action No. 10-11512-NMG (D.Mass)—Document 17-7, Filed Dec. 17, 2010, Second Amended Answer and Counterclaim of Defendants Engineered Plastics, Inc. and Access Products, Inc.—Exhibit 7 (2-Pages).
*ADA Solutions, Inc.* v. *Engineering Plastics, Inc.*—Civil Action No. 10-11512-NMG (D.Mass)—Document 18, Filed Jan. 3, 2011, Answer to Defendants' Second Amended Counterclaims (21-Pages).
*ADA Solutions, Inc.* v. *Engineering Plastics, Inc.*—Civil Action No. 10-11512-NMG (D.Mass)—Document 22, Filed Jan. 10, 2011, Joint Rule 26(f) Scheduling Statement (7-Pages).
*ADA Solutions, Inc.* v. *Engineering Plastics, Inc.*—Civil Action No. 10-11512-NMG (D.Mass)—Document 22-1, Filed Jan. 10, 2011, [Proposed] Scheduling and Case Management Order (8-Pages).
*ADA Solutions, Inc.* v. *Engineering Plastics, Inc.*—Civil Action No. 10-11512-NMG (D.Mass)—Document 25, Filed Feb. 11, 2011, Scheduling and Case Management Order (8-Pages).
*ADA Solutions, Inc.* v. *Engineering Plastics, Inc.*—Civil Action No. 10-11512-NMG (D.Mass)—Document 30, Filed Feb. 25, 2011, First Amended Complaint (6-Pages).
*ADA Solutions, Inc.* v. *Engineering Plastics, Inc.*—Civil Action No. 10-11512-NMG (D.Mass)—Document 30-1, Filed Feb. 25, 2011, US Patent No. 7,779,581 (Flaherty et al.; Issued Aug. 24, 2010) (26-Pages).
Letter from Foley Hoag dated Mar. 31, 2011 (2-Pages).
Photo accompanying GB433732A13 in London Archive—DDTAYPLA11-1—Exact date unknown—admitted prior art.
Photo accompanying GB433732A13 in London Archive—DDTAYPLA11-2—Exact date unknown—admitted prior art.
Photo accompanying GB433732A13 in London Archive—DDTAYPLA11-3—Exact date unknown—admitted prior art.
Photo accompanying GB433732A13 in London Archive—DDTAYPLA11-4—Exact date unknown—admitted prior art.
Photo accompanying GB433732A13 in London Archive—DDTAYPLA11-5—Exact date unknown—admitted prior art.
*ADA Solutions, Inc.* v. *Engineered Plastics, Inc.*—Civil Action No. 10-11512-NMG—Responses of Plaintiff ADA Solutions, Inc. to Defendants' First Set of Interrogatories, Filed Mar. 18, 2011.
*ADA Solutions, Inc.* v. *Engineered Plastics, Inc.*—Civil Action No. 10-11512-NMG—Plaintiff ADA Solutions, Inc. Rule 26 (a)(1) Initial Disclosures, Filed Jan. 20, 2011.
*ADA Solutions, Inc.* v. *Engineered Plastics, Inc.*—Civil Action No. 10-11512-NMG—Defendant's Initial Disclosures of Engineered Plastics, Inc. and Access Products, Inc.—Filed Jan. 7, 2011.
*ADA Solutions, Inc.* v. *Engineered Plastics, Inc.*— Civil Action No. 10-11512-NMG—Defendants' Answer to the First Amended Complain and Counterclaim—Document 39, Filed Mar. 23, 2011 (40-Pages).
*ADA Solutions, Inc.* v. *Engineered Plastics, Inc.*—Civil Action No. 10-11512-NMG—Document 39-1 of Amended Complaint—Exhibit 1, Filed Mar. 23, 2011 (3-Pages).
*ADA Solutions, Inc.* v. *Engineered Plastics, Inc.*—Civil Action No. 10-11512-NMG—Document 39-2 of Amended Complaint—Exhibit 2, Filed Mar. 23, 2011 (5-Pages).
*ADA Solutions, Inc.* v. *Engineered Plastics, Inc.*—Civil Action No. 10-11512-NMG—Document 39-3 of Amended Complaint—Exhibit 3, Filed Mar. 23, 2011 (2-Pages).
*ADA Solutions, Inc.* v. *Engineered Plastics, Inc.*—Civil Action No. 10-11512-NMG—Document 39-4 of Amended Complaint—Exhibit 4, Filed Mar. 23, 2011 (29-Pages).
*ADA Solutions, Inc.* v. *Engineered Plastics, Inc.*—Civil Action No. 10-11512-NMG—Document 39-5 of Amended Complaint—Exhibit 5, Filed Mar. 23, 2011 (2-Pages).

*ADA Solutions, Inc.* v. *Engineered Plastics, Inc.*—Civil Action No. 10-11512-NMG—Document 39-6 of Amended Complaint—Exhibit 6, Filed Mar. 23, 2011 (2-Pages).
*ADA Solutions, Inc.* v. *Engineered Plastics, Inc.*—Civil Action No. 10-11512-NMG—Document 39-7 of Amended Complaint—Exhibit 7, Filed Mar. 23, 2011 (2-Pages).
*ADA Solutions, Inc.* v. *Engineered Plastics, Inc.*—Civil Action No. 10-11512-NMG—Answer to Defendants' Counterclaims, Document 41, Filed Apr. 11, 2011 (43-Pages).
ADA's Cast in Place Truncated Dome Detectable Warning System product (Hand delivered to Examiner during interview on May 26, 2010).
ADA's Cast in Place Pave System (Hand delivered to Examiner during interview on May 26, 2010).
*ADA Solutions, Inc.* v. *Engineered Plastics, Inc.*—Civil Action No. 10-11512-NMG—Defendants' Preliminary Noninfringement Contentions, Document 43, Filed May 2, 2011 (9-Pages).
*ADA Solutions, Inc.* v. *Engineered Plastics, Inc.*—Civil Action No. 10-11512-NMG—Defendants' Preliminary Invalidity Contentions, Document 44, Filed May 2, 2011 (13-Pages).
*ADA Solutions, Inc.* v. *Engineered Plastics, Inc.*—Civil Action No. 10-11512-NMG—Document 44-1 of Defendants' Preliminary Invalidity Contentions—Exhibit A, Filed May 2, 2011 (83-Pages).
*ADA Solutions, Inc.* v. *Engineered Plastics, Inc.*—Civil Action No. 10-11512-NMG—Document 44-2 of Defendants' Preliminary Invalidity Contentions—Exhibit A, Filed May 2, 2011 (63-Pages).
*ADA Solutions, Inc.* v. *Engineered Plastics, Inc.*—Civil Action No. 10-11512-NMG—Defendants' Preliminary Unenforceability Contentions, Document 45, Filed May 2, 2011 (10-Pages).
*ADA Solutions, Inc.* v. *Engineered Plastics, Inc.*—Civil Action No. 10-11512-NMG—Document 45-1 of Defendants' Preliminary Unenforceability Contentions—Exhibit 1, Filed May 2, 2011 (3-Pages).
*ADA Solutions, Inc.* v. *Engineered Plastics, Inc.*—Civil Action No. 10-11512-NMG—Document 45-2 of Defendants' Preliminary Unenforceability Contentions—Exhibit 2, Filed May 2, 2011 (5-Pages).
*ADA Solutions, Inc.* v. *Engineered Plastics, Inc.*—Civil Action No. 10-11512-NMG—Document 45-3 of Defendants' Preliminary Unenforceability Contentions—Exhibit 3, Filed May 2, 2011 (2-Pages).
*ADA Solutions, Inc.* v. *Engineered Plastics, Inc.*—Civil Action No. 10-11512-NMG—Document 45-4 of Defendants' Preliminary Unenforceability Contentions—Exhibit 4, Filed May 2, 2011 (2-Pages).
*ADA Solutions, Inc.* v. *Engineered Plastics, Inc.*—Civil Action No. 10-11512-NMG—Document 45-5 of Defendants' Preliminary Unenforceability Contentions—Exhibit 5, Filed May 2, 2011 (3-Pages).
*ADA Solutions, Inc.* v. *Engineered Plastics, Inc.*—Civil Action No. 10-11512-NMG—Document 45-6 of Defendants' Preliminary Unenforceability Contentions—Exhibit 6, Filed May 2, 2011 (4-Pages).
*ADA Solutions, Inc.* v. *Engineered Plastics, Inc.*—Civil Action No. 10-11512-NMG—Document 45-8 of Defendants' Preliminary Unenforceability Contentions—Exhibit 8, Filed May 2, 2011 (7-Pages).
Re-examination Request filed May 2, 2011 in corresponding U.S. Appl. No. 90/009,907 filed May 4, 2011.
Document from West Glamorgan Archives (Swansea, England): <D/D TAY PLA 11/1-5> "Trafixigns", a form of road markings n.d. [5 glass positives], 1 of 5—Exact date unknown—admitted prior art.
Document from West Glamorgan Archives (Swansea, England): <D/D TAY PLA 11/1-5> "Trafixigns", a form of road markings n.d. [5 glass positives], 2 of 5—Exact date unknown—admitted prior art.
Document from West Glamorgan Archives (Swansea, England): <D/D TAY PLA 11/1-5> "Trafixigns", a form of road markings n.d. [5 glass positives], 3 of 5—Exact date unknown—admitted prior art.
Document from West Glamorgan Archives (Swansea, England): <D/D TAY PLA 11/1-5> "Trafixigns", a form of road markings n.d. [5 glass positives], 4 of 5—Exact date unknown—admitted prior art.
Document from West Glamorgan Archives (Swansea, England): <D/D TAY PLA 11/1-5> "Trafixigns", a form of road markings n.d. [5 glass positives], 5 of 5—Exact date unknown—admitted prior art.
Correspondence from Philip C. Swain to Robert C. Frame (May 11, 2011).
*ADA Solutions, Inc.* v. *Engineering Plastics, Inc.*—Civil Action No. 10-11512-NMG—Document 46, Filed May 6, 2011, Defendants' Corrected Preliminary Unenforceability Contentions (10-Pages).
*ADA Solutions, Inc.* v. *Engineering Plastics, Inc.*—Civil Action No. 10-11512-NMG—Document 46-1, Filed May 6, 2011, Defendants' Corrected Preliminary Unenforceability Contentions—Exhibit 1 (3-Pages).
*ADA Solutions, Inc.* v. *Engineering Plastics, Inc.*—Civil Action No. 10-11512-NMG—Document 46-2, Filed May 6, 2011, Defendants' Corrected Preliminary Unenforceability Contentions—Exhibit 2 (5-Pages).
*ADA Solutions, Inc.* v. *Engineering Plastics, Inc.*—Civil Action No. 10-11512-NMG—Document 46-3, Filed May 6, 2011, Defendants' Corrected Preliminary Unenforceability Contention—Exhibit 3 (2-Pages).
*ADA Solutions, Inc.* v. *Engineering Plastics, Inc.*—Civil Action No. 10-11512-NMG—Document 46-4, Filed May 6, 2011, Defendants' Corrected Preliminary Unenforceability Contentions—Exhibit 4 (3-Pages).
*ADA Solutions, Inc.* v. *Engineering Plastics, Inc.*—Civil Action No. 10-11512-NMG—Document 46-5, Filed May 6, 2011, Defendants' Corrected Preliminary Unenforceability Contentions—Exhibit 5 (3-Pages).
*ADA Solutions, Inc.* v. *Engineering Plastics, Inc.*—Civil Action No. 10-11512-NMG—Document 46-6, Filed May 6, 2011, Defendants' Corrected Preliminary Unenforceability Contentions—Exhibit 6 (5-Pages).
*ADA Solutions, Inc.* v. *Engineering Plastics, Inc.*—Civil Action No. 10-11512-NMG—Document 46-7, Filed May 6, 2011, Defendants' Corrected Preliminary Unenforceability Contentions—Exhibit 7 (6-Pages).
*ADA Solutions, Inc.* v. *Engineering Plastics, Inc.*—Civil Action No. 10-11512-NMG—Document 46-8, Filed May 6, 2011, Defendants' Corrected Preliminary Unenforceability Contentions—Exhibit 8 (7-Pages).
Request for Inter Partes Reexamination Transmittal Form in U.S. Patent No. 7,779,581 filed on May 26, 2011.
Detailed Request for Inter Partes Reexamination in U.S. Patent No. 7,779,581 filed on May 26, 2011 (157-Pages).
Detailed Request for Inter Partes Reexamination in U.S. Patent No. 7,779,581 filed on May 26, 2011—Exhibit 1 (U.S. Patent No. 7,779,581).
Detailed Request for Inter Partes Reexamination in U.S. Patent No. 7,779,581 filed on May 26, 2011—Exhibit 2—(Information Disclosure Citation).
Detailed Request for Inter Partes Reexamination in U.S. Patent No. 7,779,581 filed on May 26, 2011—Exhibit 3 (File History Excerpt, Claims After Preliminary Amendment, Apr. 11, 2009).
Detailed Request for Inter Partes Reexamination in U.S. Patent No. 7,779,581 filed on May 26, 2011—Exhibit 4 (File History Excerpt: Notice of Allowability, Jun. 11, 2010).
Detailed Request for Inter Partes Reexamination in U.S. Patent No. 7,779,581 filed on May 26, 2011—Exhibit 5 (Szekely Declaration dated May 23, 2011).
Detailed Request for Inter Partes Reexamination in U.S. Patent No. 7,779,581 filed on May 26, 2011—Exhibit A (Szekely Declaration dated May 23, 2011).
Detailed Request for Inter Partes Reexamination in U.S. Patent No. 7,779,581 filed on May 26, 2011—Exhibit B (Szekely Declaration dated May 23, 2011).
Detailed Request for Inter Partes Reexamination in U.S. Patent No. 7,779,581 filed on May 26, 2011—Exhibit C (Szekely Declaration dated May 23, 2011).
Detailed Request for Inter Partes Reexamination in U.S. Patent No. 7,779,581 filed on May 26, 2011—Exhibit D (Szekely Declaration dated May 23, 2011).

Detailed Request for Inter Partes Reexamination in U.S. Patent No. 7,779,581 filed on May 26, 2011—Exhibit 6 (Sollins Declaration dated May 26, 2011).
Detailed Request for Inter Partes Reexamination in U.S. Patent No. 7,779,581 filed on May 26, 2011( Information Disclosure Citation Form).
Detailed Request for Inter Partes Reexamination in U.S. Patent No. 7,779,581 filed on May 26, 2011 (U.S. Patent No. 5,303,669).
Detailed Request for Inter Partes Reexamination in U.S. Patent No. 7,779,581 filed on May 26, 2011 (U.S. Patent No. 6,273,657).
Detailed Request for Inter Partes Reexamination in U.S. Patent No. 7,779,581 filed on May 26, 2011 (U.S. Patent No. 7,674,066).
Detailed Request for Inter Partes Reexamination in U.S. Patent No. 7,779,581 filed on May 26, 2011 (U.S. Publication No. 2007/0269264).
Detailed Request for Inter Partes Reexamination in U.S. Patent No. 7,779,581 filed on May 26, 2011 (Australian Patent No. 21,483).
Detailed Request for Inter Partes Reexamination in U.S. Patent No. 7,779,581 filed on May 26, 2011 (United Kingdom Patent No. 486,128).
Detailed Request for Inter Partes Reexamination in U.S. Patent No. 7,779,581 filed on May 26, 2011 (Materials related to ADA Solutions' Cast-in-Place Truncated Dome Detectable..).
Detailed Request for Inter Partes Reexamination in U.S. Patent No. 7,779,581 filed on May 26, 2011 (Engineered Plastics Drawing No. ADA-P044-BA4-24M).
Detailed Request for Inter Partes Reexamination in U.S. Patent No. 7,779,581 filed on May 26, 2011 (Engineered Plastics Drawing No. ADA-S203-GEN2-06X48).
Detailed Request for Inter Partes Reexamination in U.S. Patent No. 7,779,581 filed on May 26, 2011 (The Americans with Disabilities Act Accessibility Guidelines).
Detailed Request for Inter Partes Reexamination in U.S. Patent No. 7,779,581 filed on May 26, 2011 (Engineered Plastics Drawing No. ADA-C-1212).
Request for Inter Partes Reexamination Transmittal Form in U.S. Patent No. 7,779,581 filed on May 26, 2011.
Detailed Request for Inter Partes Reexamination in U.S. Patent No. 7,779,581 filed on May 26, 2011 (157-Pages).
Detailed Request for Inter Partes Reexamination in U.S. Patent No. 7,779,581 filed on May 26, 2011—Exhibit 1 (U.S. Patent No. 7,779,581).
Detailed Request for Inter Partes Reexamination in U.S. Patent No. 7,779,581 filed on May 26, 2011—Exhibit 2—(Information Disclosure Citation).
Detailed Request for Inter Partes Reexamination in U.S. Patent No. 7,779,581 filed on May 26, 2011—Exhibit 3 (File History Excerpt, Claims After Preliminary Amendment, Apr. 11, 2009).
Detailed Request for Inter Partes Reexamination in U.S. Patent No. 7,779,581 filed on May 26, 2011—Exhibit 4 (File History Excerpt: Notice of Allowability, Jun. 11, 2010).
Detailed Request for Inter Partes Reexamination in U.S. Patent No. 7,779,581 filed on May 26, 2011—Exhibit 5 (Szekely Declaration dated May 23, 2011).
Detailed Request for Inter Partes Reexamination in U.S. Patent No. 7,779,581 filed on May 26, 2011—Exhibit A (Szekely Declaration dated May 23, 2011).
Detailed Request for Inter Partes Reexamination in U.S. Patent No. 7,779,581 filed on May 26, 2011—Exhibit B (Szekely Declaration dated May 23, 2011).
Detailed Request for Inter Partes Reexamination in U.S. Patent No. 7,779,581 filed on May 26, 2011—Exhibit C (Szekely Declaration dated May 23, 2011).
Detailed Request for Inter Partes Reexamination in U.S. Patent No. 7,779,581 filed on May 26, 2011—Exhibit D (Szekely Declaration dated May 23, 2011).
Detailed Request for Inter Partes Reexamination in U.S. Patent No. 7,779,581 filed on May 26, 2011—Exhibit 6 (Sollins Declaration dated May 26, 2011).
Detailed Request for Inter Partes Reexamination in U.S. Patent No. 7,779,581 filed on May 26, 2011 (Information Disclosure Citation Form).
Detailed Request for Inter Partes Reexamination in U.S. Patent No. 7,779,581 filed on May 26, 2011 (U.S. Patent No. 5,303,669).
Detailed Request for Inter Partes Reexamination in U.S. Patent No. 7,779,581 filed on May 26, 2011 (U.S. Patent No. 6,273,657).
Detailed Request for Inter Partes Reexamination in U.S. Patent No. 7,779,581 filed on May 26, 2011 (U.S. Patent No. 7,674,066).
Detailed Request for Inter Partes Reexamination in U.S. Patent No. 7,779,581 filed on May 26, 2011 (U.S. Publication No. 2007/0269264).
Detailed Request for Inter Partes Reexamination in U.S. Patent No. 7,779,581 filed on May 26, 2011 (Australian Patent No. 21,483).
Detailed Request for Inter Partes Reexamination in U.S. Patent No. 7,779,581 filed on May 26, 2011 (United Kingdom Patent No. 486,128).
Detailed Request for Inter Partes Reexamination in U.S. Patent No. 7,779,581 filed on May 26, 2011 (Materials related to ADA Solutions' Cast-in-Place Truncated Dome Detectable..).
Detailed Request for Inter Partes Reexamination in U.S. Patent No. 7,779,581 filed on May 26, 2011 (Engineered Plastics Drawing No. ADA-P044-BA4-24M).
Detailed Request for Inter Partes Reexamination in U.S. Patent No. 7,779,581 filed on May 26, 2011 (Engineered Plastics Drawing No. ADA-S203-GEN2-06X48).
Detailed Request for Inter Partes Reexamination in U.S. Patent No. 7,779,581 filed on May 26, 2011 (The Americans with Disabilities Act Accessibility Guidelines).
Detailed Request for Inter Partes Reexamination in U.S. Patent No. 7,779,581 filed on May 26, 2011 (Engineered Plastics Drawing No. ADA-C-1212).
*ADA Solutions, Inc.* v. *Engineered Plastics, Inc.*—Civil Action No. 10-11512-NMG—Filed May 27, 2011, Engineered Plastics, Inc.'s and Access Products, Inc.'s Objections and Responses to ADA Solutions, Inc.'s Amended First Set of Interrogatories (20-Pages).

* cited by examiner

REPLACEABLE WET-SET TACTILE WARNING SURFACE UNIT AND METHOD OF INSTALLATION AND REPLACEMENT

CROSS REFERENCE TO RELATED APPLICATIONS

This application is a continuation of U.S. patent application Ser. No. 12/115,595, which in turn claims priority of Provisional Patent Application Ser. No. 60/916,887, filed on May 9, 2007, and Provisional Patent Application Ser. No. 61/014,361, filed on Dec. 17, 2007, the entire disclosures of which are incorporated herein by reference.

FIELD OF THE INVENTION

The present invention relates to a wet set replaceable tactile warning surface unit that can be embedded in fresh concrete, but can be quickly and easily removed and replaced without disturbing the underlying substrate.

BACKGROUND OF THE INVENTION

Tactile Warning Surface (TWS) products are required in certain locations under the Americans with Disabilities Act Accessibility Guidelines (ADAAG). The ADAAG defines certain types of applications, including curb ramps/pedestrian crossings, commercial applications (e.g., big box retailers, hotels and restaurants) and transit facilities (e.g., commuter rail, rapid transit and Bus Rapid Transit (BRT)). The visually impaired may elect to utilize TWS products to detect hazardous drop-offs (platform edge/loading dock) and hazardous vehicular areas (curb ramps on street corners and intersections, uncurbed transition between pedestrian and vehicular areas such as at the front of big box retail establishments).

Visually impaired and fully sighted persons may rely on a combination of visual cues (color contrast), tactile cues (sweeping cane, sole of shoe, through wheelchair wheels, walker wheels), and audio cues (sound attenuation, which can be achieved by use of dissimilar materials such as composite TWS and concrete substrate) when electing to use TWS products as a means of edge and hazardous vehicular area detection.

TWS products define a series of spaced raised truncated domes. See, e.g., U.S. Pat. No. 7,001,103 for a discussion of TWS products. These products are typically installed in curb ramps, pedestrian ways and commercial areas by setting into the fresh concrete a plastic, composite or metal TWS product that defines on its upper surface the series of spaced raised truncated domes required by the ADAAG. Although such Cast-In-Place (CIP) TWS products are easy to install into wet concrete (typically taking only a few minutes), replacement is difficult and time consuming, and replacement costs are high, because the underlying substrate must be at least partially destroyed in order to remove an installed product, and then reconstructed for the replacement product.

Some of these CIP TWS Units define a relatively thin upper surface layer supported underneath by spaced honeycomb-like lower walls that are set in fresh concrete. Air can be trapped between the lower walls, which creates areas underneath the CIP TWS Unit that are not supported by the underlying substrate. Because they are thin to begin with, and in spots not supported, these CIP TWS Units can fatigue and crack under moderate or heavy loading, such as can be caused by pallet jacks, fork lifts and vehicles, for example. Also, due to the plurality of intersecting lower walls that are embedded in concrete, in some cases these CIP TWS Units cannot be replaced without tearing up and then rebuilding the concrete structure in which they were set; this is a time consuming and expensive proposition.

Another issue with ADAAG-compliant TWS products is that the projecting domes can be broken or sheared off by snowplows or the like, requiring replacement. Some fiberglass-reinforced epoxy resin TWS products have a body that is reinforced by a woven fiberglass mat. However, the domes are constructed of pure resin without any fiberglass reinforcement for impact resistance. These TWS products thus have projecting domes that are inherently weaker than the body. The domes thus can be more easily cracked, broken or sheared off.

Some CIP TWS Units are set into fresh concrete with fasteners that pass through holes located in the domes. There are also CIP TWS Units in which the head of the fastener is shaped like a dome, in which case the fastener is located in place of one of the domes. In both such cases, if a dome is sheared or broken off, there is danger that the head of the fastener can be sheared or broken off, or at a minimum the fastener can be loosened. If this happens, the TWS product can come loose and present a tripping hazard.

The prior state of the art for new construction includes composite shell CIP TWS Units. Composite shell CIP TWS Units are quickly and economically installed; however, if the installer is not diligent CIP TWS Units are susceptible to air entrapment underneath the CIP TWS Unit and are thus susceptible to fatigue and cracking failure due to repetitive and/or heavy loading. Fatigue and cracking failure under repetitive heavy loading may also occur along the relatively thin perimeter flange structure. Once installed, CIP TWS Units are permanently embedded into the concrete substrate and it is thus difficult, invasive, time consuming, and costly to remove and replace CIP TWS Units when maintenance is required.

Another solution is a surface applied (SA) TWS panel that is applied to a finished substrate. A SA TWS panel is typically mechanically fastened (e.g., with a nylon sleeve anchor with a stainless steel pin) and adhered (e.g., using single component urethane adhesive) to the underlying substrate, and then caulked around the perimeter to compensate for substrate irregularities, minimize water intrusion, and provide a superior architectural finish. Installation takes 10-15 minutes for a 2'×4' SA TWS panel. Replacement of a SA TWS panel is easier than with a CIP TWS Unit, and is typically accomplished by removing the fasteners, heating the SA TWS panel to break the adhesive bond with the underlying substrate, prying the TWS panel off the substrate, removing existing adhesive, and installing a new SA TWS panel. The substrate basically remains intact. Perhaps 1 to 1½ hours labor is involved. Replacement cost is thus moderate. However, these SA TWS panels can more easily loosen or dislodge as compared to CIP TWS units. For example, a protruding edge or corner of the SA TWS panel can be caught by a snow plow and lifted. This can present a safety hazard. SA TWS panels are thus not as acceptable as CIP TWS Units. SA TWS panels are an ideal solution for retrofit applications; CIP or replaceable (REP) TWS Units are an ideal, quick, and economical solution for new construction. The elevation of the body of a SA TWS panel is at least ⅛" above the surface of the underlying substrate; consequently, the body of the SA TWS panel is potentially vulnerable to damage from snow removal operations. The body of CIP or REP TWS Units are flush mounted relative to the adjacent substrate; consequently, the body of the TWS Unit is shielded or protected from damage due to snow removal operations. Flush mounted TWS Product installations offer superior performance when compared to surface mounted TWS Product installations. As the fasteners in SA TWS Panels are located within the truncated dome, they are vulnerable to damage from snow removal or similar shearing type action that the domes may be subjected to under everyday use.

There is thus the need for a wet-set replaceable TWS Unit that is rugged so less likely to be damaged or loosened from the underlying substrate, uses fasteners that are less likely to be damaged by heavy equipment, and can be quickly, easily and economically replaced without reconstruction of the underlying substrate (such as a curb ramp or transit platform), or dealing with adhesive application and removal.

SUMMARY OF THE INVENTION

This invention features a heavy-duty, wet-set, replaceable tactile warning surface (TWS) unit that installs easily. One embodiment of the inventive wet set TWS unit comprises a body defining an upper surface and a lower surface, the body defining a series of raised projections on its upper surface, and defining a plurality of spaced through-holes from the top to the bottom surface, in which the raised projections are spaced from one another and the through-holes are located in the field between projections. The wet set TWS Unit has an equal plurality of anchor members coupled to its bottom surface directly below the through-holes by an equal plurality of fasteners (such as bolts) that pass through the through-holes.

The inventive wet set TWS Unit is preferably unitary, solid and essentially homogeneous. In one embodiment, the body is made from a chopped fiber (e.g., fiberglass) reinforced resin composite material, and the unitary projections are also made from the same composite material. Alternatively, the body and the projections may be made from a metal material, such as stainless steel. The body may define a perimeter flange that is thicker than the rest of the body. The inventive unit may in that case further comprise a plurality of spaced slots passing through the perimeter flange that allow air to escape from underneath the unit when it is installed in fresh concrete; the slots may communicate with the bottom of the flange and the area underneath the body inside of the flange. The perimeter flange may define an inner surface (and potentially also an outer surface) that is tapered such that the bottom of the flange is narrower than the top of the flange where it meets the rest of the body, to facilitate removal of the inventive unit from set concrete. The perimeter flange may be about one inch wide. In one specific embodiment, the perimeter flange has a thickness of about ⅝.sup.th inches, and the rest of the body, with the exception of the locations of the projections, has a thickness of about ⅜.sup.th inches.

The raised projections may define truncated dome shapes. The size, shape and pattern of the truncated domes preferably meets the present requirements for the ADAAG. At least some of the upper surface between projections may define a roughened surface. The roughened surface may be accomplished with a large number of small projecting asperities that are preferably on essentially the entire surface, including the tops of the domes.

The anchor members preferably comprise metal concrete inserts. The fasteners (bolts) are preferably metal hex-cap bolts. The lower surface of the body surrounding each of the through-holes may define a downwardly-protruding lower projection. The downwardly-protruding lower projections may define a tapered, generally truncated conical shape such that the bottom of the projection is narrower than the location at which the projection meets the rest of the body. The conical shape of the lower projections may define a taper angle of about 120 degrees.

The body proximate each through-hole may be offset downward to define a recess in the upper surface. The fasteners may define an enlarged head that is located in a recess, such that the head does not project above the upper surface of the body that surrounds the recess. There may be an equal plurality of watertight structural caps that are fitted into the recesses to cover the heads of the bolts. The structural caps may define a generally circular perimeter with a flat area. The recesses may define a shoulder, in which case the caps sit on the shoulders. The cap is preferably both structural and provides an essentially watertight seal to the body.

Also featured is a method of installing the inventive unit, comprising placing it into fresh concrete and applying force to the top of the wet set REP TWS unit to embed it in the concrete such that its edges are approximately flush with the top surface of the concrete. There are few, if any, air pockets underneath the installed inventive unit, which provides it overall with superior support from the underlying substrate. This, along with the thickness and uniformity of the body, and the thickened perimeter flange, accomplish a wet set REP TWS Unit that is much less likely to crack or break than other composite TWS products.

The inventive unit may be replaced if necessary by removing the caps and bolts, prying it off of the underlying substrate, and leaving the inserts (anchor members) embedded in the underlying concrete substrate. An essentially identical replacement TWS Unit is then placed on the substrate such that its through-holes are aligned with the embedded inserts, and fixing the replacement unit to the substrate by passing bolts through the through-holes and into the internally threaded inserts.

In a more specific embodiment, the invention features a wet-set REP TWS Unit comprising an essentially solid and homogeneous generally flat body made of a fiberglass-reinforced resin composite material, and defining an upper surface and a lower surface, the body further defining a series of integral spaced raised projections on its upper surface, in which the raised projections define truncated dome shapes, the size, shape and pattern of the truncated domes meeting the present requirements for the ADAAG. The body further defines a perimeter flange that is thicker than the rest of the body, the perimeter flange defining an inner surface that is tapered such that the bottom of the flange is narrower than the top of the flange where it meets the rest of the body, to facilitate removal of the inventive unit from a fully cured concrete substrate. The body further defines a plurality of spaced through-holes from the top to the bottom surface that are located in the field between projections, in which the body proximate each through-hole is offset downward to define a recess in the upper surface, and in which the lower surface of the body surrounding each of the through-holes defines a downwardly-protruding lower projection that defines a tapered, generally truncated conical shape such that the bottom of the projection is narrower than the location at which the projection meets the rest of the body. There are a plurality of flared threaded inserts, one coupled to the bottom surface of the body directly below each of the lower projections by an equal plurality of fasteners (bolts) that pass through the through-holes, in which the bolts define an enlarged head that is located in a recess, such that the head essentially does not project above the upper surface of the body that surrounds the recess.

Another more specific embodiment features a wet-set REP TWS Unit comprising an integral metal body defining an upper surface and a lower surface, the body further defining a series of integral spaced raised projections on its upper surface, in which the raised projections define truncated dome shapes, the size, shape and pattern of the truncated domes meeting the present requirements for the ADAAG. The body further defines a plurality of spaced through-holes from the top to the bottom surface that are located in the field between projections, in which the body proximate each through-hole is offset downward to define a depression in the upper surface. There are a plurality of threaded inserts (anchor members), one coupled to the bottom surface of the body directly below each of the through-holes by an equal plurality of fasteners (bolts) that pass through the through-holes, in which the bolts define an enlarged head that is located in a depression, such that the head essentially does not project above the upper surface of the body proximate the recess.

The inventive REP TWS Unit is of a heavy-duty construction that typically will not crack or fatigue under heavy vehicular loading. The inventive unit is quick and easy to install, with essentially no air entrapment, which causes failure in most CIP TWS products. The inventive unit is quickly and economically replaced without disturbance to the underlying substrate. This makes the inventive unit particularly advantageous to big box retailers that need to periodically replace TWS Product at store entrances with little or no disruption to retail operations or inconvenience to customers of the retail establishment. (The inventive REP TWS Unit can be replaced when the store is shut down, with the area ready for customer use for the next day's retail operation. Little skill is required to install the inventive REP TWS Unit.)

BRIEF DESCRIPTION OF THE DRAWINGS

Various other objects, features and advantages of the present invention will become fully appreciated as the invention becomes better understood when considered in conjunction with the accompanying drawings showing non-limiting embodiments of the invention, wherein like numbers are used for like parts, and lower case letters are used where a part is the same or performs the same function as a part given the same number without a lower case letter, and in which:

FIG. 3A is a view similar to that of FIG. 1F, but showing a fastener added to the inventive unit;

DETAILED DESCRIPTION OF EMBODIMENTS OF THE INVENTION

Figure 1A:
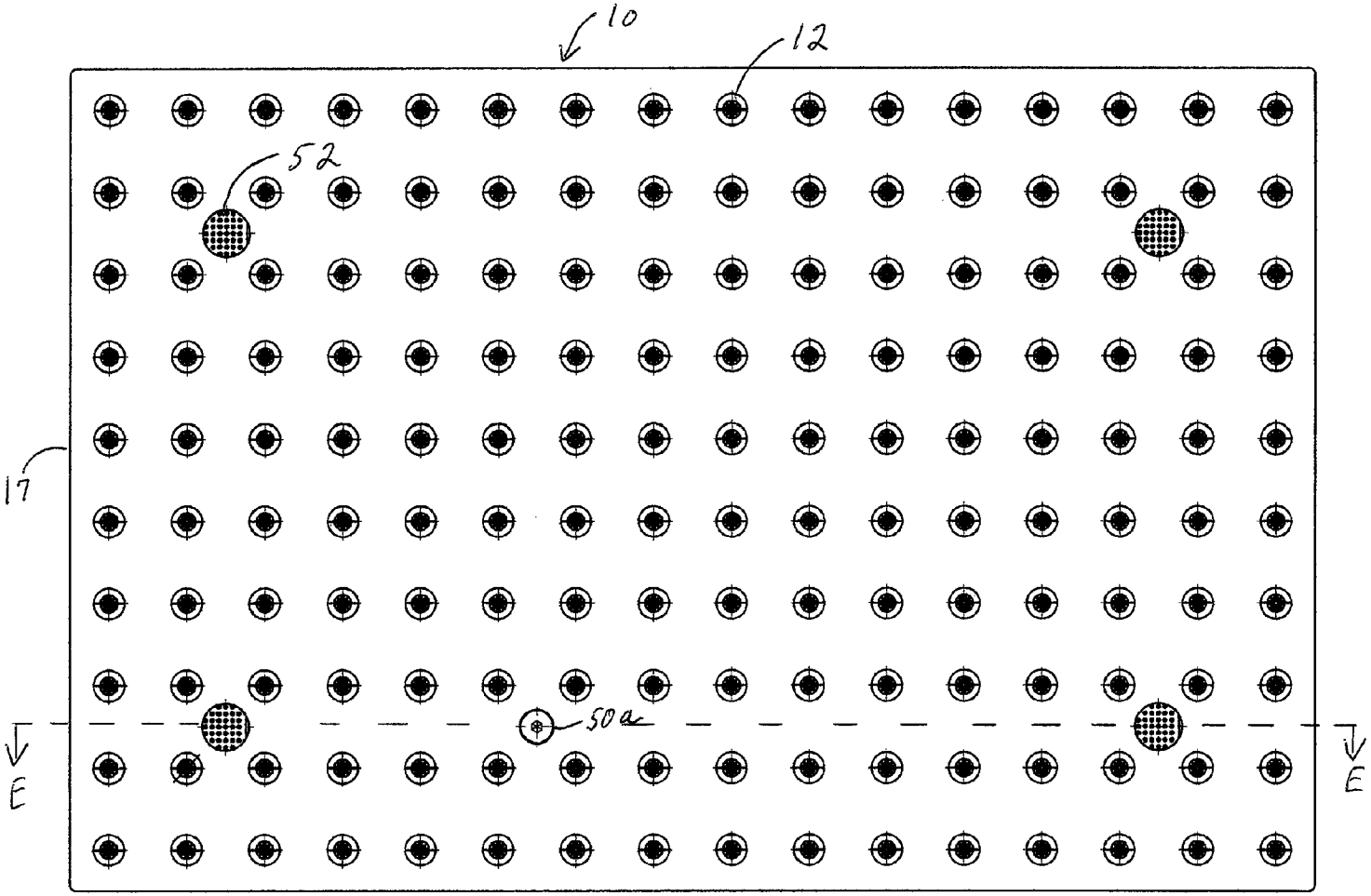
FIGS. 1A, 1B, 1C and 1D are top, side, bottom and end views, respectively, of a first embodiment of the wet-set REP TWS Unit of the invention.
Figure 1B:
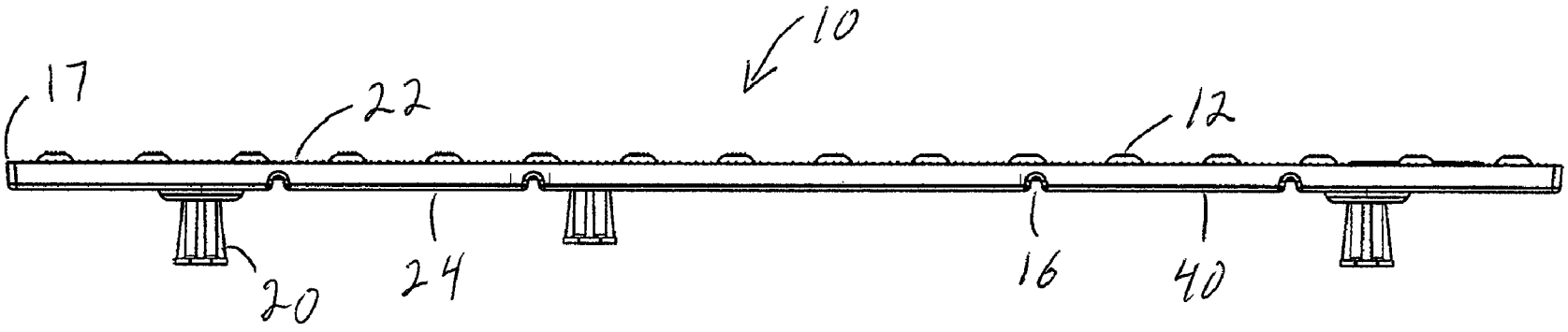
Figure 1C:
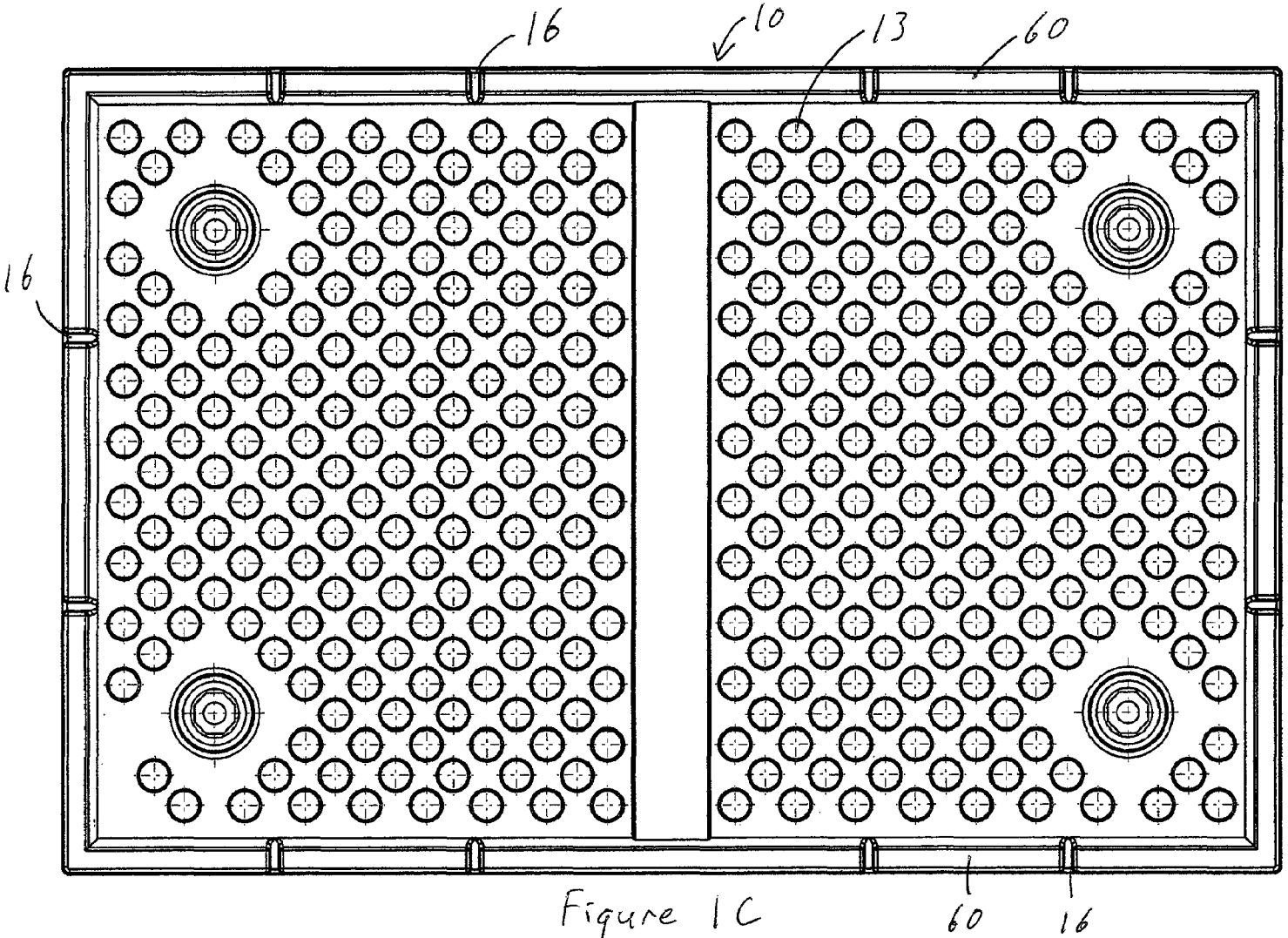
Figure 1D:
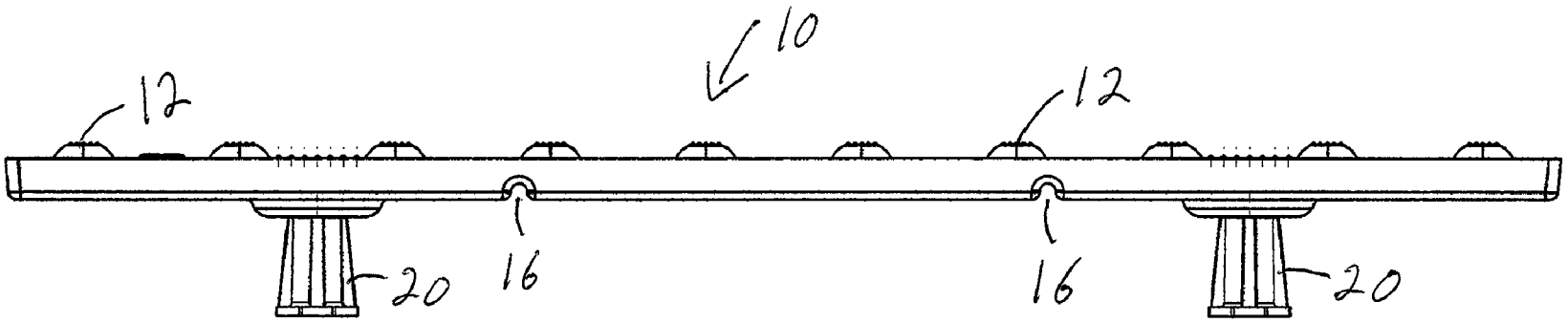
Figure 1E:
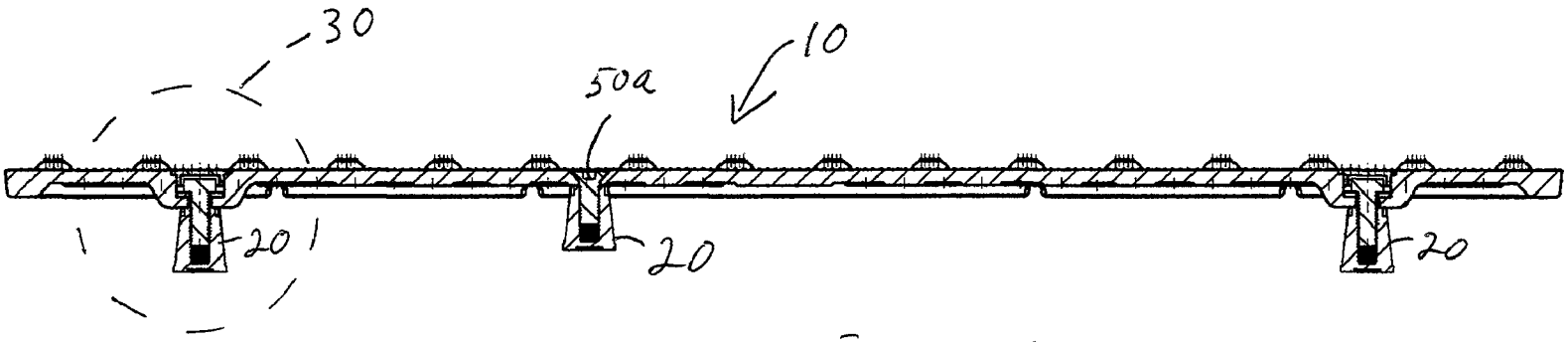
FIG. 1E is a cross-sectional view taken along line E-E of FIG. 1A.
Figure 1F:
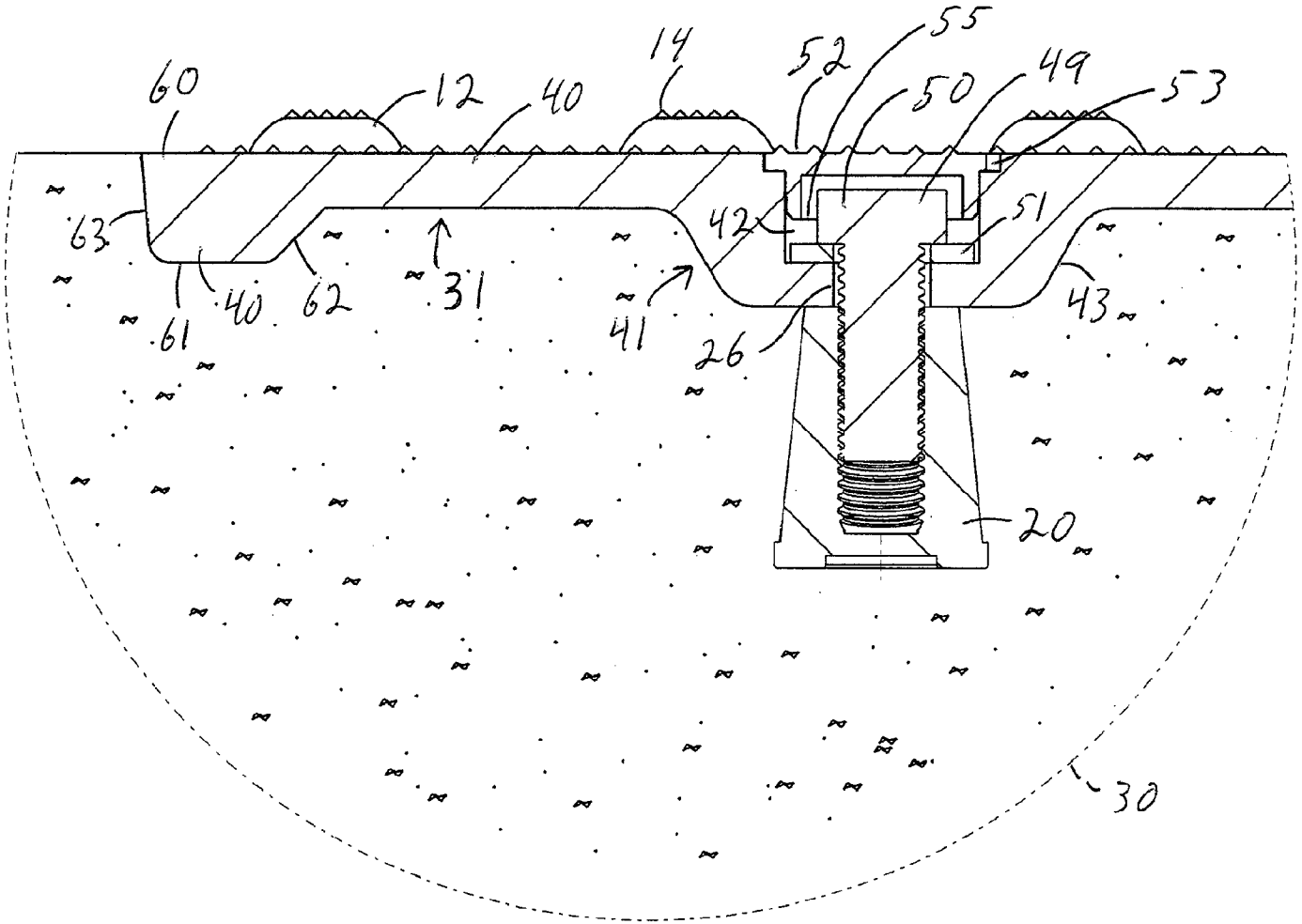
FIG. 1F is a partial, enlarged cross-sectional view of portion 30 of FIG. 1E, showing the concrete in which the inventive unit is set.
Figure 2A:
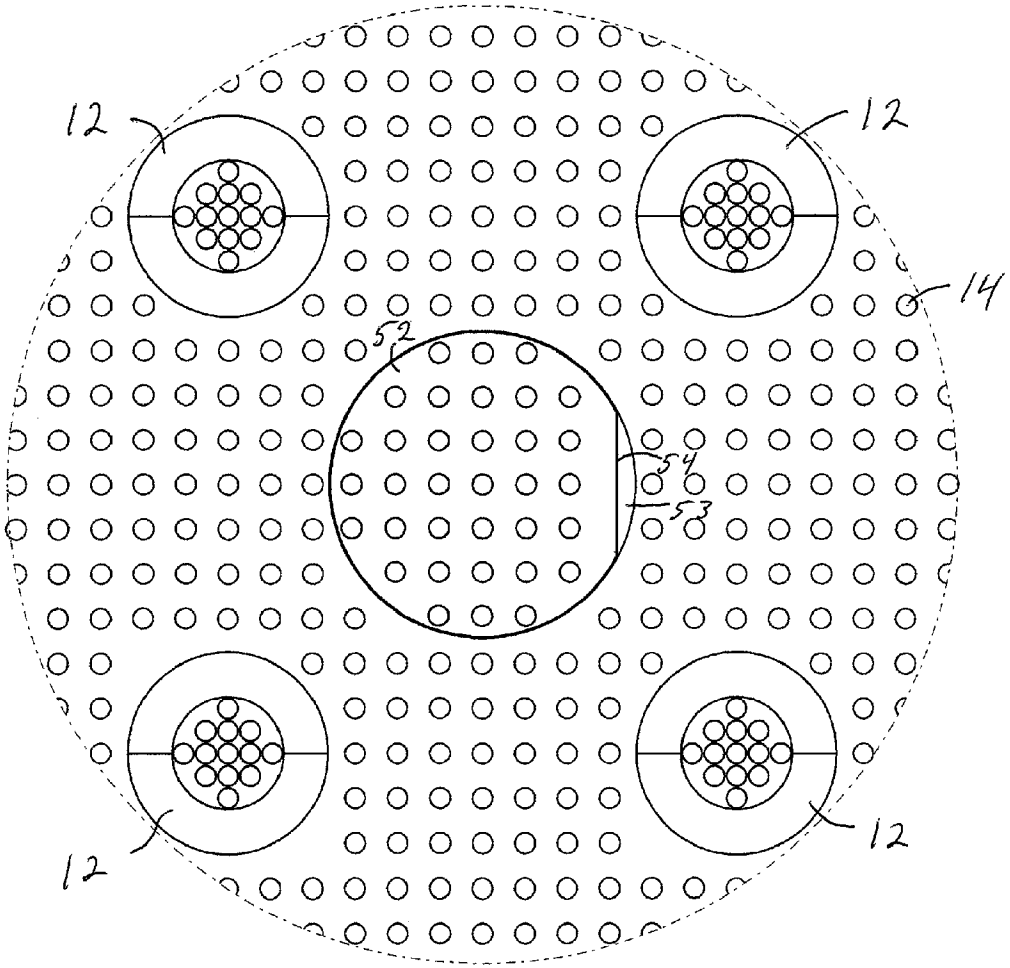
FIG. 2A is an enlarged partial top view showing one structural watertight cap assembled onto the body of the first embodiment of the invention.
Figure 2B:
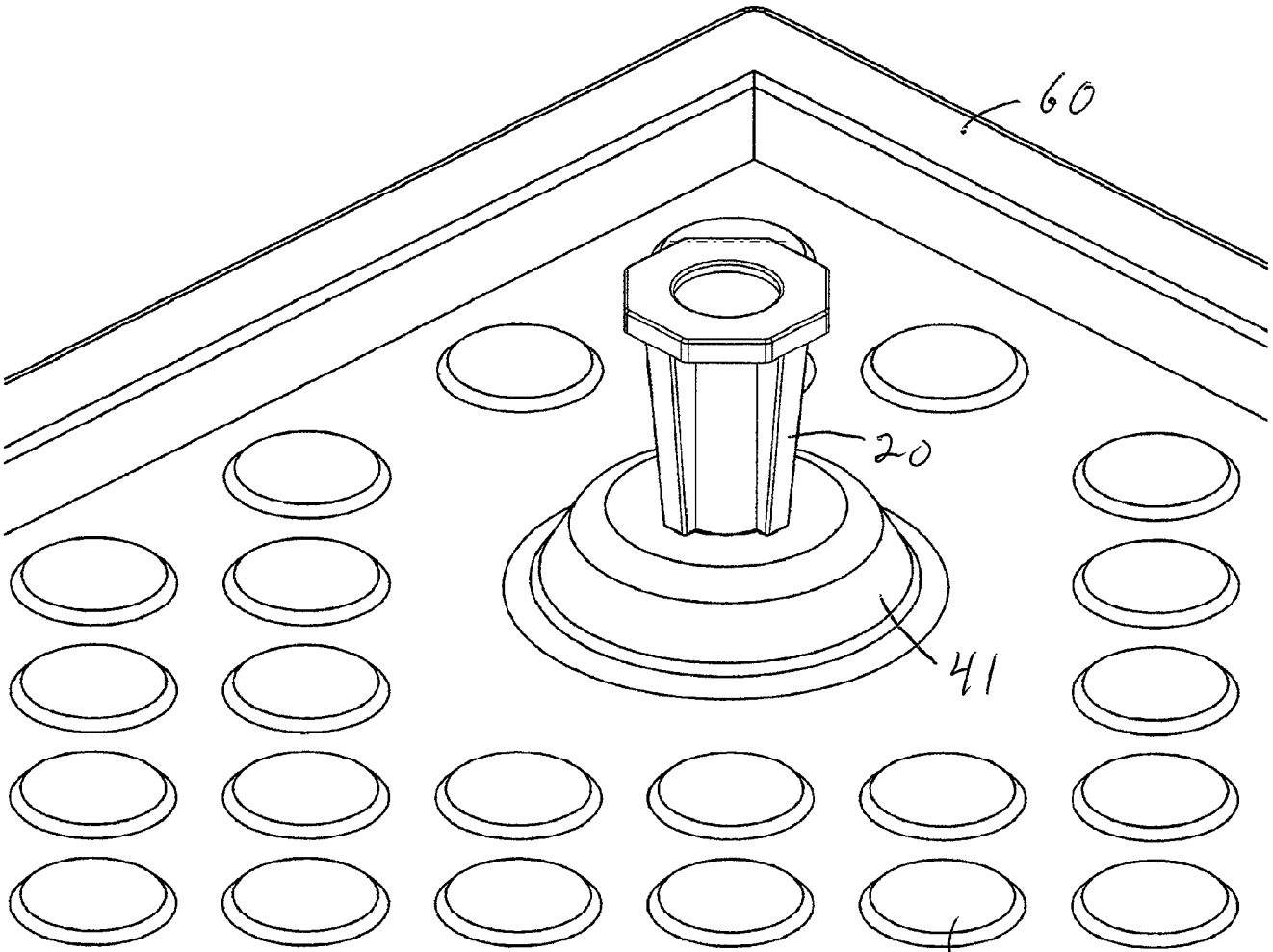
FIG. 2B is a partial, enlarged, bottom perspective view of the first embodiment of the inventive unit.
Figure 34:
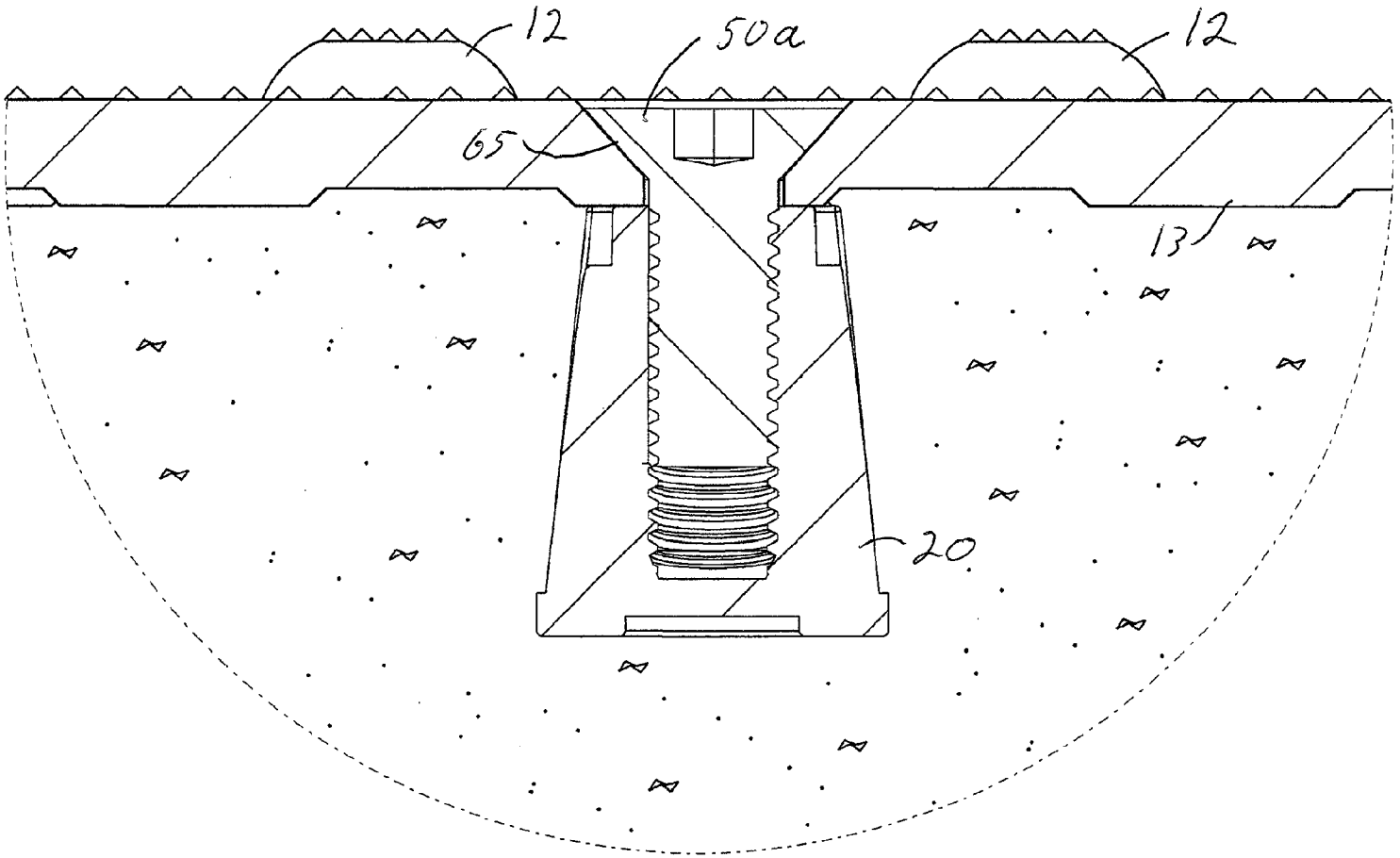
Figure 3B:
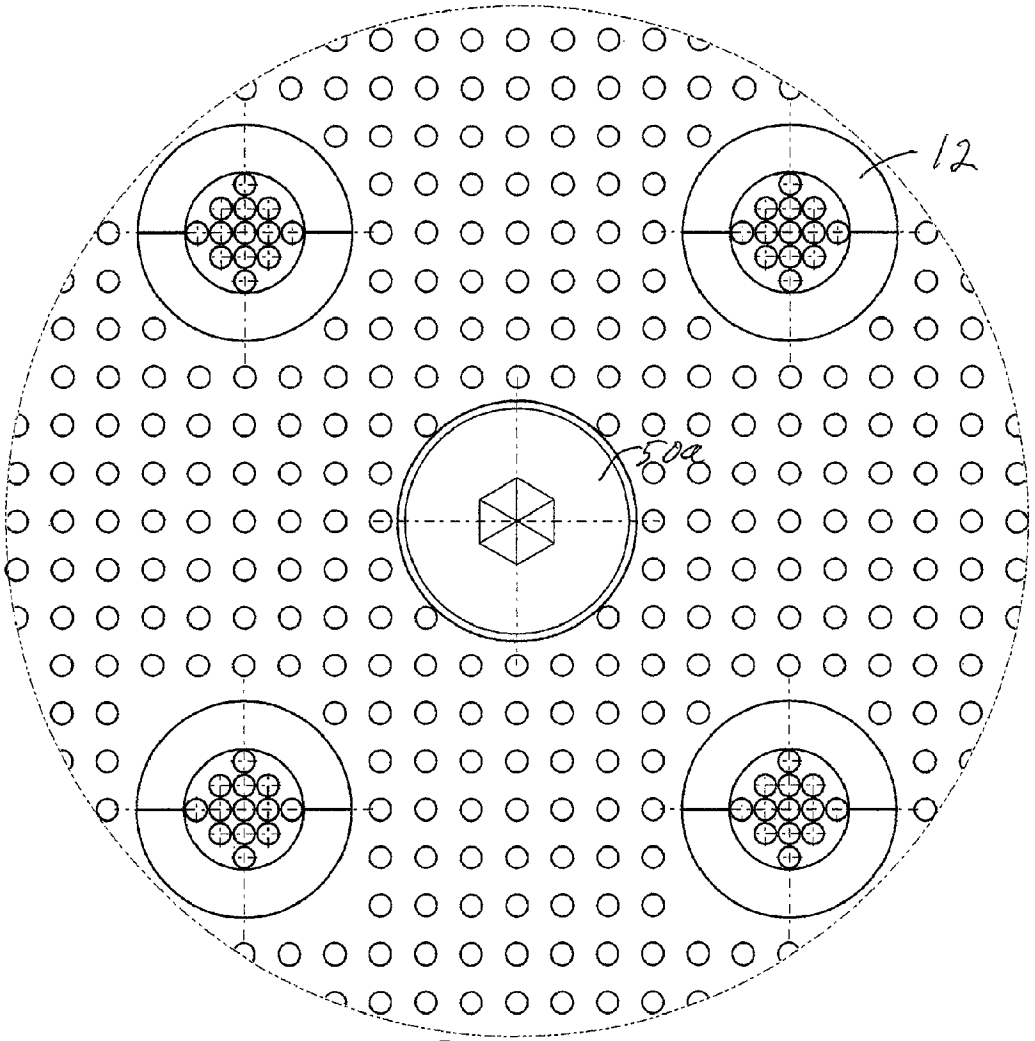
FIG. 3B is a top view of FIG. 3A.

A first preferred embodiment of the invention is accomplished in a fiberglass reinforced resin composite wet set REP TWS Unit 10, shown in FIGS. 1-3. Unit 10 may be a unitary, essentially homogeneous fiberglass-reinforced composite body 40 that defines a plurality of protruding, truncated domes 12 and/or other shapes such as oblong bars or other desirable projection shapes. In one embodiment, the size, shape and spacing of the projections meets the present requirements for the ADAAG. Body 40 has upper surface 22 with dimples 14, and lower surface 24. Holes 26 pass through the thickness of body 40. These holes are accomplished by molding into the body a recess 42 in upper surface 22, and an aligned, downwardly-protruding lower projection 41 in lower surface 24. Projection 41 preferably has a tapered, generally truncated conical shape defining tapered sides 43. Projections 41 may define a taper angle of about 120 degrees, although such is not a limitation of the invention. Lower surface 24 may have small projecting bosses 13 that add thickness and thus strength.

In one non-limiting example of the composite wet-set REP TWS Unit of the invention, some of the key dimensions are as follows: domes 12 may be about 0.9" wide at the base and 0.45" at the top, with a height of 0.2", and center-to-center spacing of about 2.35" (the spacing may range from 1.6" to 2.4"; the wider spacing provides more room for unobstructed passing of wheeled devices such as walkers and shopping carts), with the domes in a square grid array (also termed "in-line" or orthogonal pattern). Dimples 14 (located on the surface of the unit and the top surface of the domes, but not shown in all drawings, for the sake of clarity only) are 90 degree cones about 0.045" high, and closely spaced together. These add to the slip resistance (the coefficient of friction) of the surface, which is about 1.18 dry and 1.05 wet. For comparison, the ADAAG requirements for a non-slip surface are 0.6 wet or dry on a flat surface and 0.8 on a sloped surface. Body 40 is 0.312" thick, and bosses 13 are 0.062" high. Lower projections 41 sidewalls 43 are at an angle of about 60 degrees. Watertight structural cap 52 has a diameter of 1.125".

Inventive unit 10 is preferably essentially solid and unitary and possesses a slip resistant matte finish, which makes it appear less slippery, makes it actually less slippery, and also makes it less reflective, which cuts down on glare when sunlight is at low angles. The matte finish is perceived to be more slip resistant than a shiny finish, even in a dry state. This provides more comfort for pedestrians. Unit 10 is preferably made of a homogeneous chopped fiberglass and resin mixture with added colorant. The result is that all portions of the unit, including the enlarged flange, the projecting domes and the surface dimples comprise fiberglass-reinforced composite material. The domes thus do not present weak areas that can more easily crack, shear or break as compared to the body of the inventive unit. Also, as the top wears due to foot and vehicular traffic, neither the color nor the coefficient of friction of unit 10 changes. These advantages dramatically increase the useful life of unit 10.

In one embodiment, unit 10 is made as follows. The material is a thermoset polyester resin based, mineral filled, fiberglass reinforced compound. There are additives to control dimensional stability, weathering and appearance. Ultraviolet stability is accomplished using a combination of UV absorbers and hindered amine light stabilizers. Excellent flame spread and smoke density rating per the UL E-84 flammability test is produced by a combination of 30 micron and 3.5 micron particles of alumina trihydrate filler that together comprise about 50% of the formulation. There is over 20% fiberglass reinforcement in the compound for strength requirements. The fiberglass used is Owens Corning Fiberglass-957. This glass has good weather resistance for this application. A 65%/35% chop length combination of 1" and ½" lengths of the fiberglass allow it to flow throughout the substrate and into the truncated domes for added strength in those areas.

Inventive unit 10 may be manufactured as follows. First, all the components except the fiberglass reinforcement and a chemical thickening agent (magnesium oxide) are mixed to yield a paste that has the consistency of thick paint. This is accomplished using a high shear mixing system. Then, the paste is mixed with the thickening agent through a series of static mixers, and metered onto a compounding machine. At this point the blended paste and thickener are deposited as a thin layer onto the carrier film that acts as the packaging for the finished blank. The film is a co-extruded film of polyethylene and nylon that acts as a styrene barrier. The deposition happens at two places through the use of upper and lower doctor boxes. Between these two boxes is where the fiberglass roving goes through a chopper and is deposited on the paste-coated carrier film. The amount of fiberglass per square foot and the thickness of the paste determine the final fiberglass percent, and weight per square foot of the finished blank. These three components come together and go through a compaction system comprised of two steel mesh chain belts. Pressure is applied and this action squeezes the paste and fiberglass together. The fiberglass strands are designed to absorb the paste. The sheet molding compound is sandwiched between the two layers of carrier film and is festooned into a box. Within about 24 to 48 hours the chemical thickener acts on the material, changing it to the consistency of leather. The material is then molded to its final shape.

Inventive unit 10 is adapted to be wet-set into fresh concrete, but can be easily removed and replaced after the concrete has fully cured. This feature is accomplished by including a plurality of anchors (e.g., internally threaded inserts) 20 (preferably at least four per unit) that are mechanically coupled to body 40 by an appropriate means, typically with hex-head bolts or similar heavy-duty fasteners 50 with optional washers 51, as shown in detail in FIGS. 2A and 2B. The depression or recess 42 where the bolt head 49 lies is sufficiently deep such that the head does not project above the upper surface of the body. In this way, snowplows or other heavy equipment moving over the unit cannot catch and bend or shear off the bolt. The bolts are typically located about 5" inside of the perimeter of the unit. This arrangement helps to maintain a sturdy connection of the unit to the underlying supporting substrate, and also reduces the need to add bolt locations when the REP TWS Unit is cut to accommodate most radial applications. Removable structural, watertight cap 52 covers recess 42 and bolt 50 to provide a more uniform appearance and upper surface texture with dimples 14. Cap 52 also inhibits the collection of dirt and other debris around the head of the screw, to facilitate bolt removal. Cap 52 preferably provides a watertight seal to the body of the unit as well, to inhibit water infiltration which can lead to corrosion of the bolts thus weakening of the coupling of the inventive unit to the underlying substrate. Threaded inserts 20 are typically flared, heavy-duty zinc members, such as 1.5 inch long precast concrete inserts. Inserts 20 have a generally tubular main body with internal threading to accept a threaded fastener, and flared ribs that end at an enlarged lower circular or hexagonal base having a diameter of about 1.25 inches. The flared shape and enlarged base help to firmly embed the anchors (inserts) in the concrete substrate as it sets. Stainless steel hex-head bolts are typically used as removable fasteners 50.

The inventive unit is wet-set into fresh concrete as follows: the appropriate number of anchors 20 (one for each opening 26 through which a fastener 50 passes) are secured to the underside 24 of body 40 with an equal number of bolts 50 and washers 51. Each of the cavities 42 of body 40 that accommodates a bolt head are then covered with a cap cover 52 that is preferably seated on a shoulder 55 as shown in FIGS. 2A, 2B and 2C. It is preferable to remove about ¼" of concrete to minimize concrete displacement when pressing the inventive unit in place, and minimize regarding the adjacent concrete substrate. It is also preferable to install the inventive unit when the slump value of the concrete is in the 4"-7" range. The assembled inventive unit is then placed down onto the top of the fresh concrete, often times in a curb ramp, pedestrian crossing or hazardous vehicular way being constructed. The unit is then set into concrete 59 by pressing down on the it and tamping with a rubber mallet or vibrating the unit until it is set such that its top 22 is approximately flush with the top of the surface of concrete 59, as shown in FIG. 2A. To ensure that adjacent units are level relative to one another, a small piece of plywood with suitable weight distributed on it may be placed on two or more units, spanning the joint line between the units, and left in place until the concrete has set. A ¼" edge treatment may be created around the perimeter to facilitate future replacement. Adjacent units should be spaced a nominal ⅛" apart, to allow for expansion. This can be accomplished by using ⅛" tile spacer blocks. The perimeter and the joint between adjacent units is caulked (preferably with a urethane sealant) once the concrete has set, to inhibit the collection of water underneath the edges of the inventive unit.

Since this embodiment is both solid and homogeneous, it can be easily cut and ground to be fitted to a non-rectangular location, or one that is smaller than the inventive unit itself. If such trimming causes an unacceptable reduction in the number of fastener locations, new fastener locations can be added between domes by drilling and countersinking holes 65 through the body as necessary using a ⅞" countersink bit. Hex-drive flat-head ½" bolts 50*a* with heads that fit into the countersunk flared recess are used, as the heads will lie essentially flush with or below the upper surface of the inventive unit.

Slots 16 spaced around the perimeter of body 40 (with at least one slot 16 along each of the four sides) pass through the thickness of flange 60 and extend essentially up to the lower surface of the main portion of body 40, to allow essentially all of the air to escape from underneath body 40 (in the recessed area 31 underneath body 40 inside of flange 60) to the outside as the inventive unit is pushed down into the fresh concrete. This helps to ensure that there are essentially no air cavities beneath body 40 after installation; such air cavities present areas that are not supported by the concrete that can lead to cracking and failure when the unit is exposed to heavy loads such as pallet jacks and other vehicles passing over the installed unit. The additional 0.25" thickness and 1" width of perimeter flange 60 adds strength to the perimeter. The perimeter, specifically the upper corners 17 thereof, receive the brunt of impact forces as vehicles move over the unit, and tend to be the locations at which prior, thinner units without a thicker flange, crack and break. The increased thickness of flange 60 helps to prevent such impact-induced failures.

If the inventive unit needs to be removed after the concrete has set, cap covers 52 are pried off; cap covers 52 have one flat side 54 that creates a small space 53 between the cap and the walls of hole 26 that allows the insertion of a screwdriver to pry off the cap. An appropriate tool can then be used to remove the bolts. Due to the draft or angle of the downwardly projecting portions 41, and the angle of inner wall 62 and outer wall 63 of perimeter flange 60 (resulting in lower flange portion 61 that is more narrow than where the flange meets the main body), the unit can be easily pried off the concrete surface with a pry bar or the like. Inserts 20 remain embedded in the concrete. A replacement unit can then be placed down into the location of the removed unit with the holes aligned with the embedded inserts, and then bolted to those inserts.

Figure 4A:
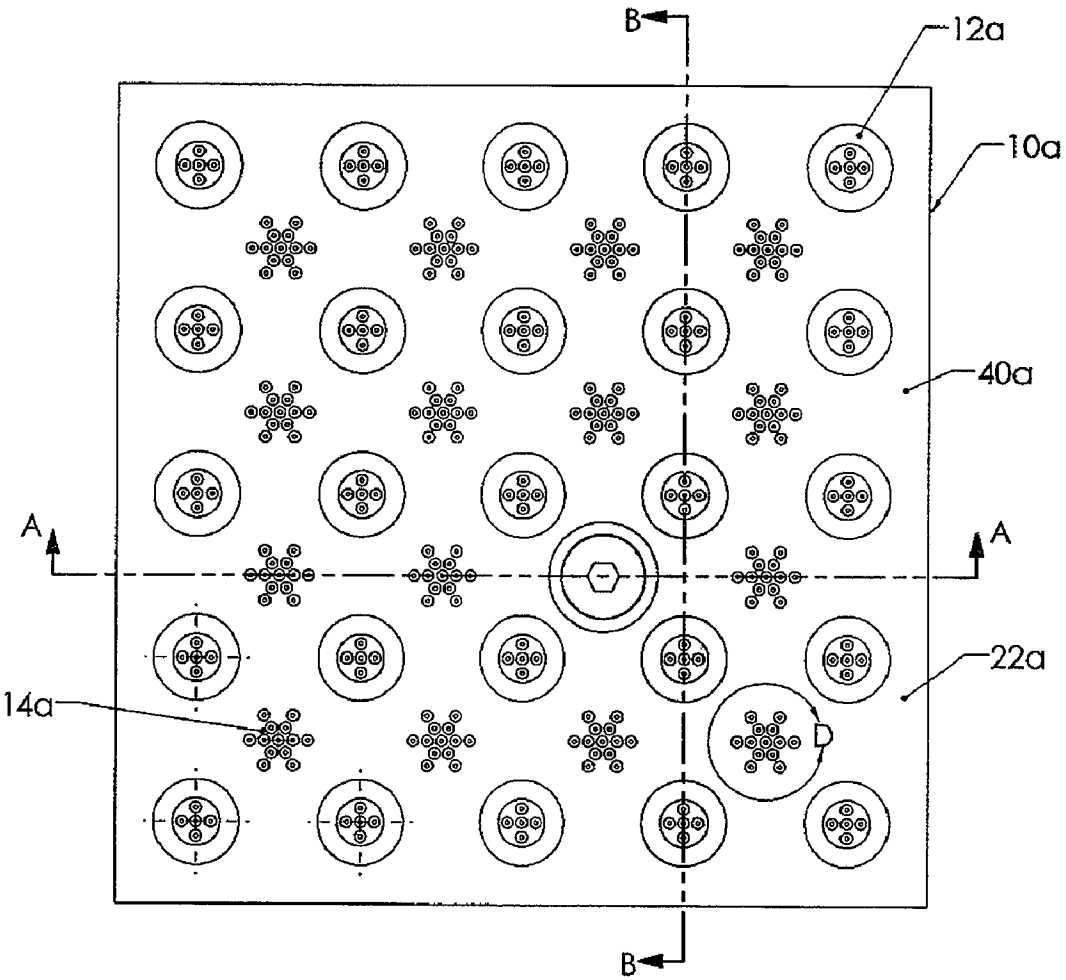
FIG. 4A is a partial top view of a second embodiment of the wet set REP TWS Unit of the invention.
Figure 4B:
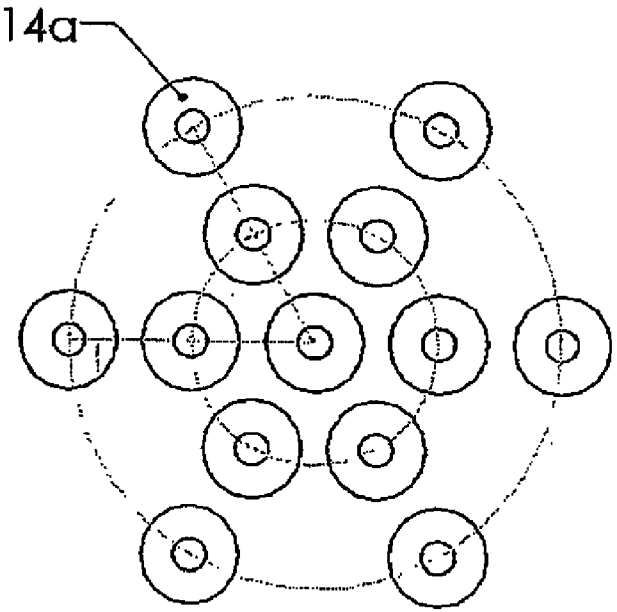
FIG. 4B is an enlarged view of a surface dimple pattern of the second embodiment of the inventive unit.
Figure 5A:
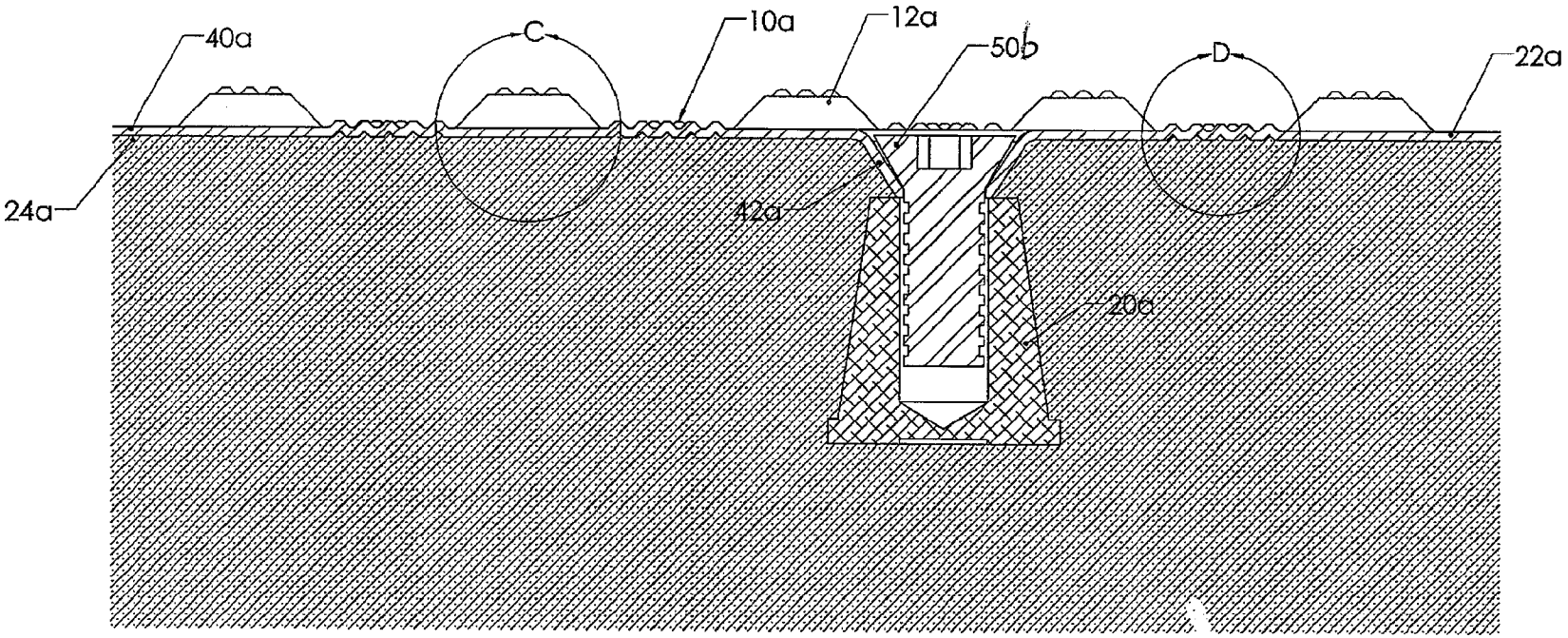
FIG. 5A is a cross-sectional view taken along line A-A of FIG. 4A.
Figure 5B:
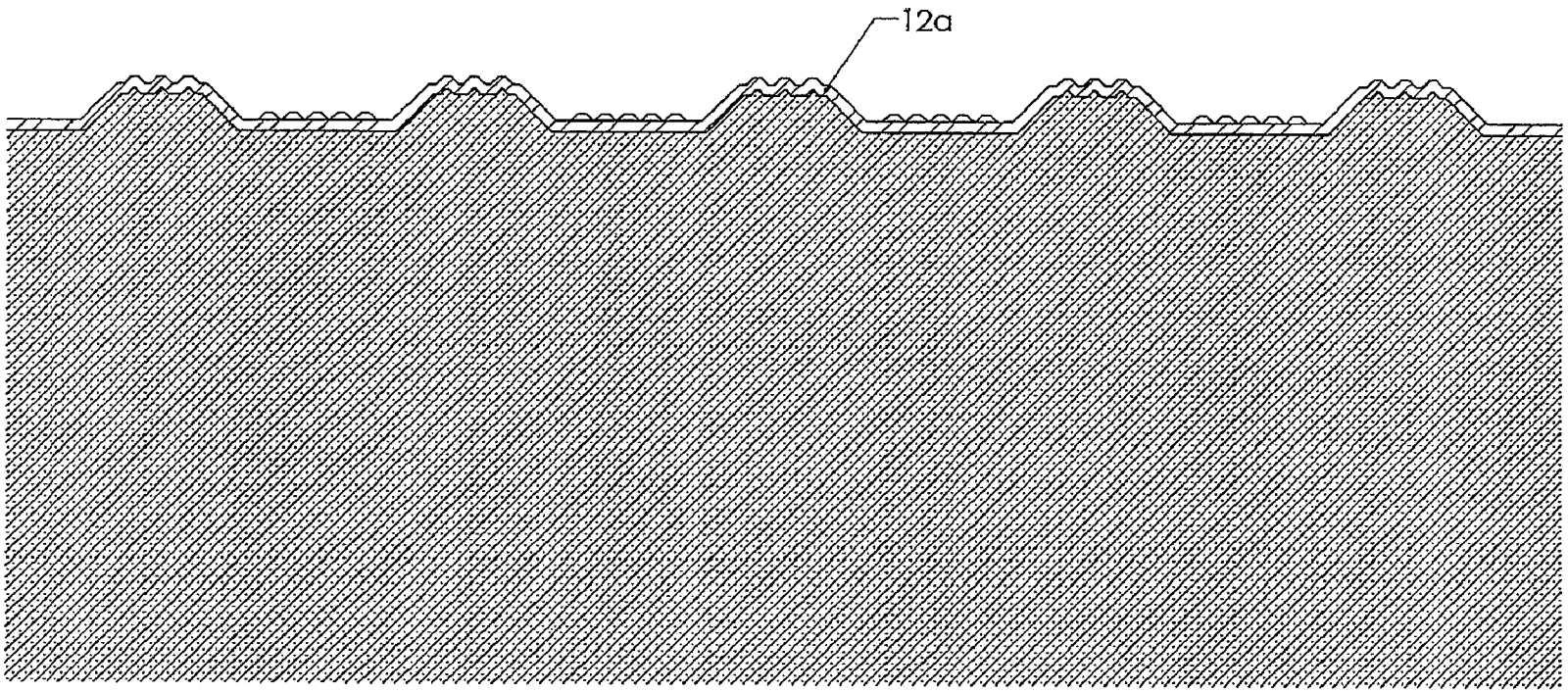
FIG. 5B is a cross-sectional view taken along line B-B of FIG. 4A.
Figure 5C:
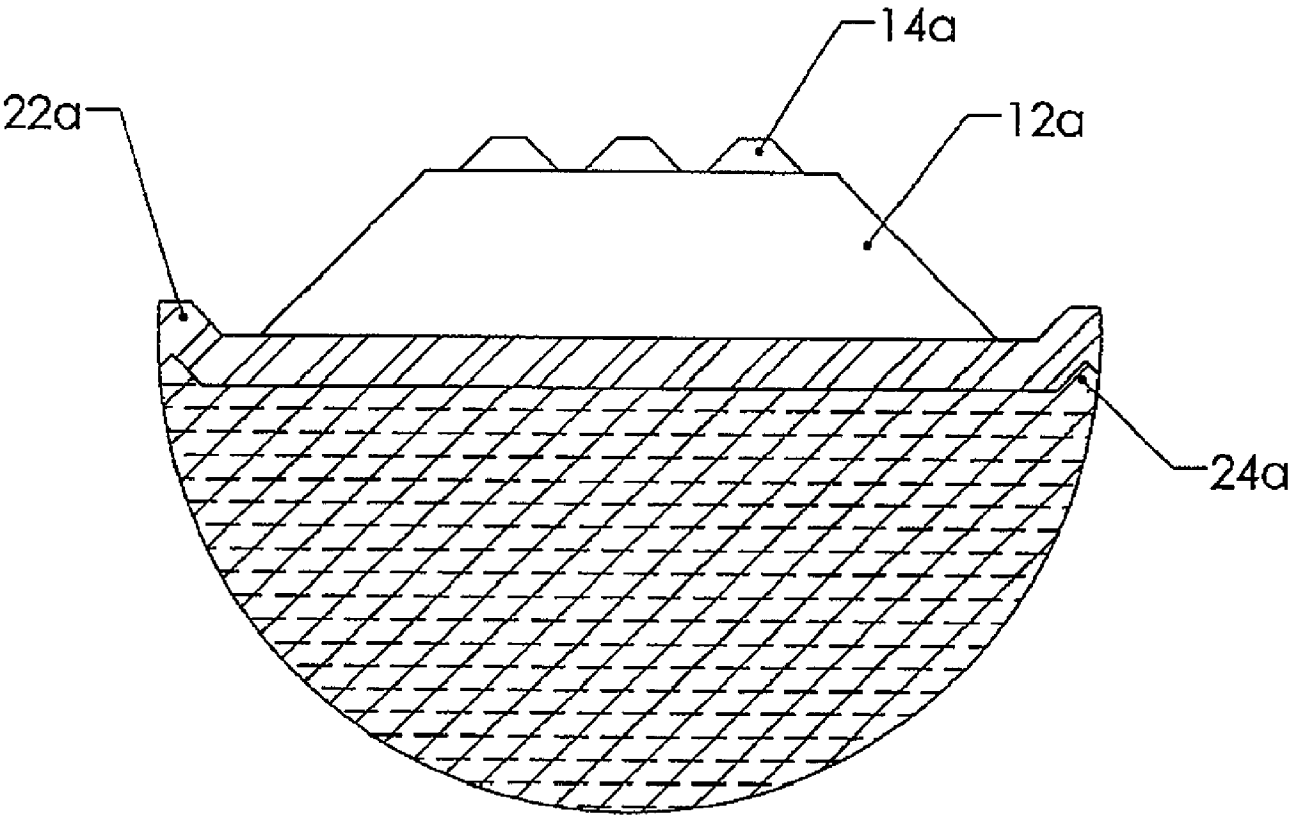
FIG. 5C is a greatly enlarged view of area "C" from FIG. 5A.
Figure 5D:
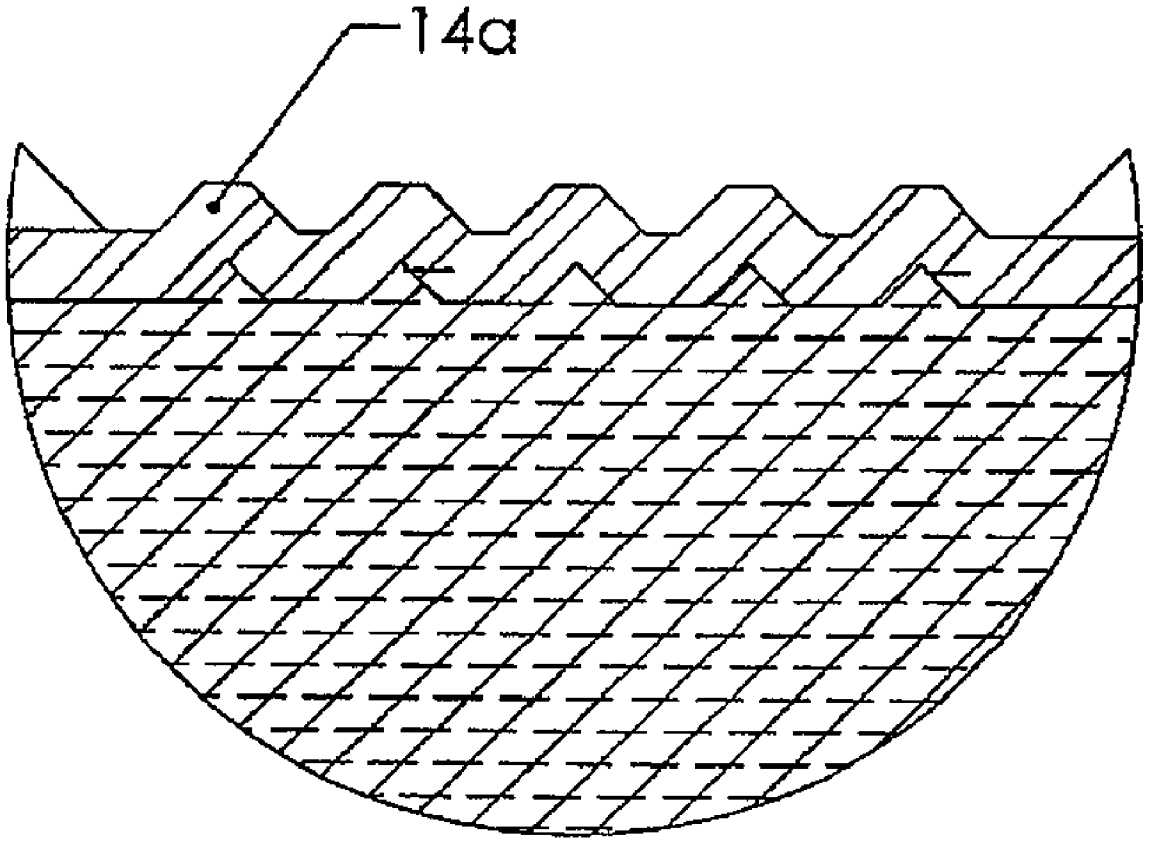
FIG. 5D is a greatly enlarged view of area "D" from FIG. 5A.
Figure 6A:
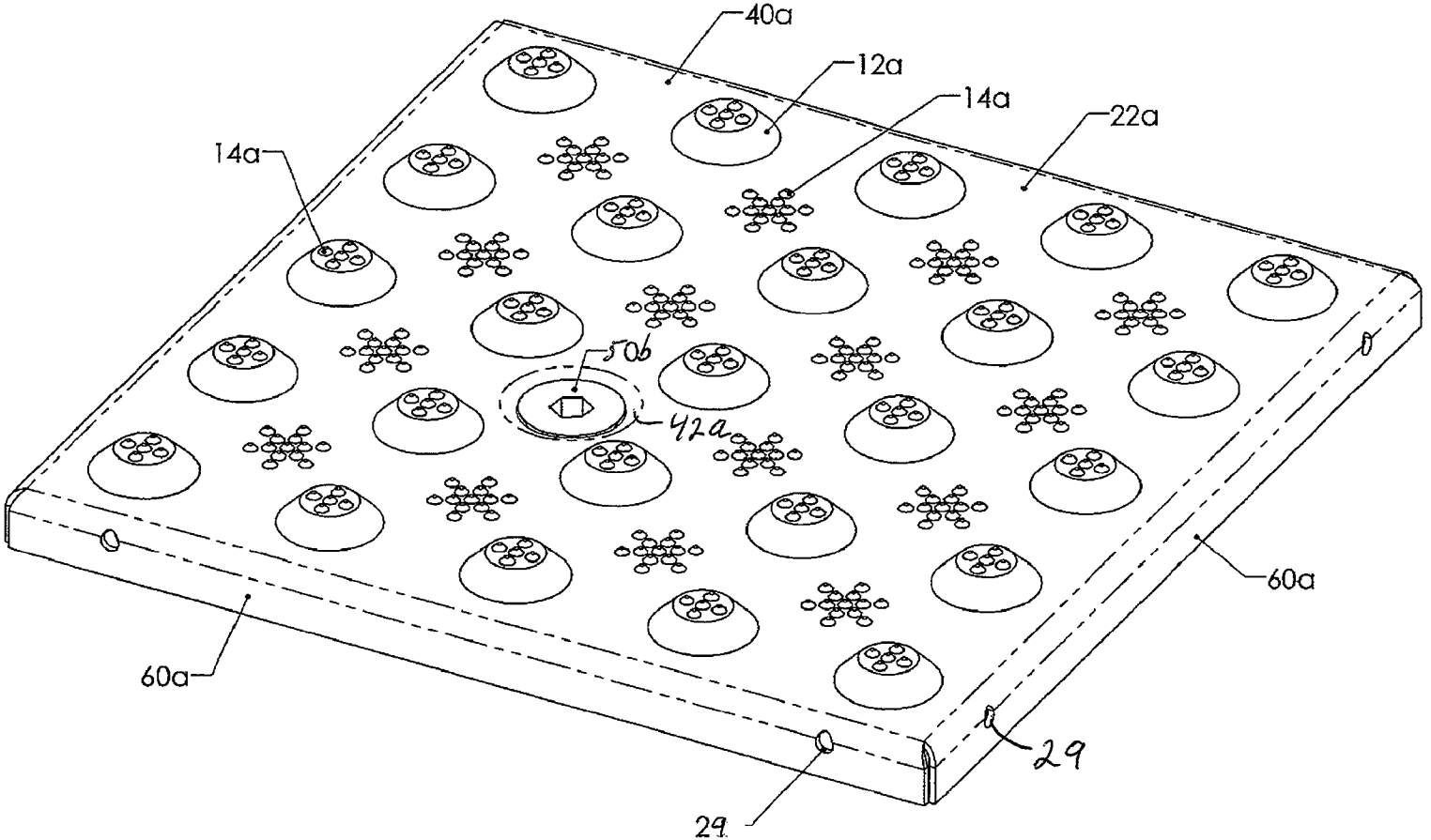
FIG. 6A is a perspective view of the second embodiment of the inventive unit.
Figure 6B:
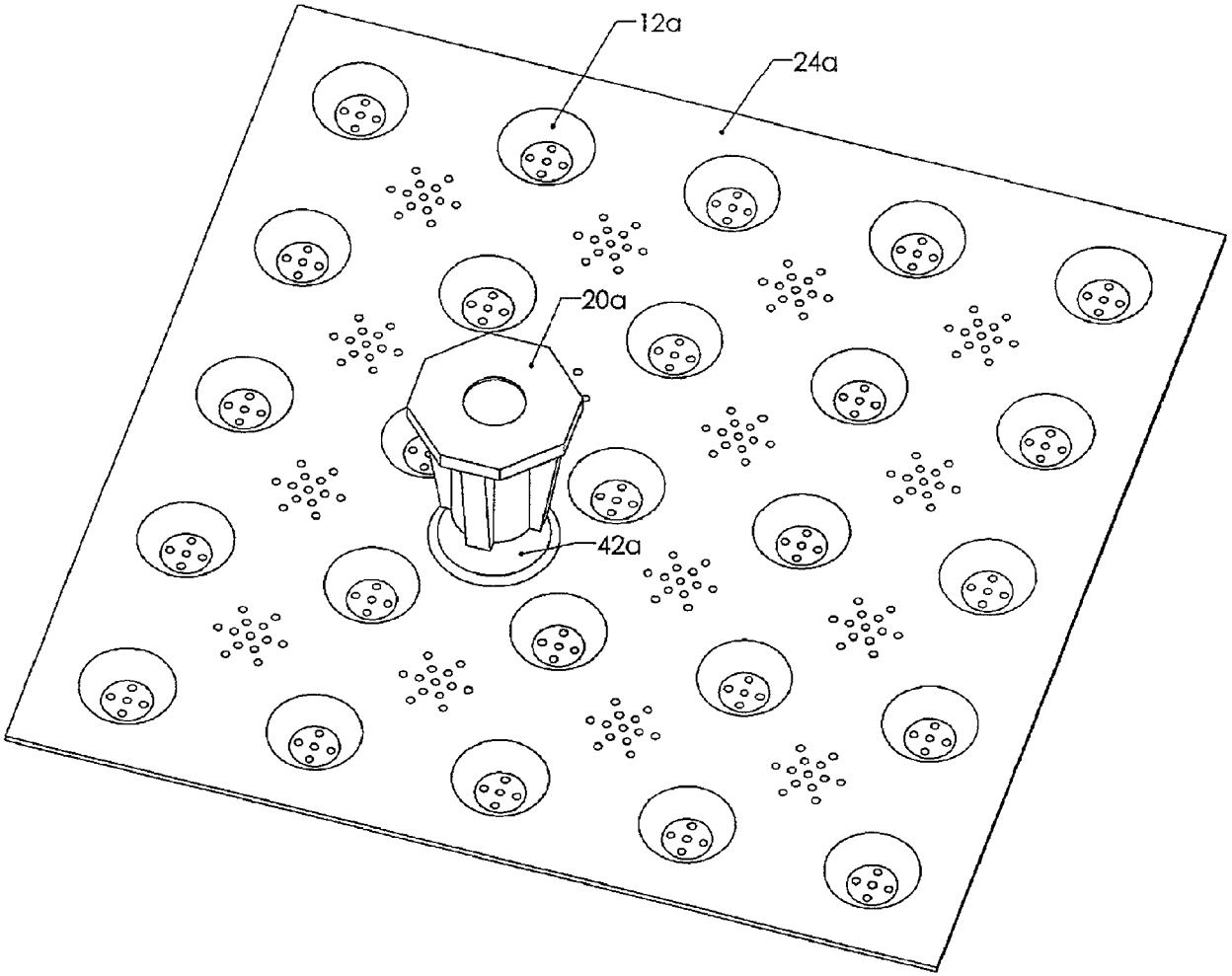
FIG. 6B is a bottom view of the second embodiment of the inventive unit.

A second preferred embodiment of the invention may be accomplished in a metal wet set REP TWS Unit 10*a*, shown in FIGS. 4-6. Inventive unit 10*a* may be a unitary metal (preferably 16 GA type 304L stainless steel) body 40*a* that defines a series of protruding, truncated domes 12*a* that are compliant with the ADAAG. Dimples 14*a* may be interspersed between domes 12*a* in the field on the surface of body 40*a*. Top surface 22*a* of body 40*a* may be coated with a high-grade matte finish exterior grade non-slip powder coating system. The slip resistance (the coefficient of friction) of the surface is about 0.91 dry and 0.80 wet, both of which meet the ADAAG requirements.

Inventive unit 10*a* is preferably fabricated from 16-gauge type 304 stainless steel. A variety of other material types, materials gauges, and finishing options are available. Alternate materials include, carbon steel, aluminum, and galvanized steel, along with various other grades of stainless steel including (but not limited to) 201, 301, 430. Material options are available to allow for a variety of application, durability, or cost considerations. The stainless steel wet set REP TWS Units offer the highest combined level of strength and corrosion resistance. Aluminum offers a high level of corrosion resistance however does not provide the same strength as stainless steel. Galvanized material would offer good corrosion resistance and above average strength while carbon steel would offer above average strength but a lower level of corrosion resistance compared to the other material options.

The material thickness for inventive unit 10*a* is preferably 16-gauge, however the thickness can be up to 11-gauge with appropriate tooling modifications. Inventive unit 10*a* can be fabricated on a press machine using custom designed and fabricated punch tooling. The panels are adjusted for flatness as necessary to relieve stresses in the material created by the punching process. Appropriate bends are added to the panel for required final application. Two-layer powder paint is applied to protect the panel from wear and weather. Stage I is the application of a Sherwin Williams POWDURA® Epoxy Powder Coating primer while Stage II is the application of a Sherwin Williams POWDURA® Polyester Powder Coating topcoat of specified color. Alternate painting options are possible based on specific application. Laboratory testing has indicated that the primer coat provides little or no additional corrosion resistance protection compared to only one layer of topcoat on the stainless steel panels.

Inventive unit 10*a* is adapted to be wet-set into fresh concrete, but can be removed and replaced after the concrete has fully cured. This feature is accomplished by including a plurality of anchors (inserts) 20*a* that are mechanically coupled to body 40*a* by an appropriate means, typically with hex-head bolts 50*b* in countersunk holes 42*a*. Anchors 20*a* are typically flared, heavy-duty zinc or stainless steel members, such as the concrete inserts described above. Stainless steel hex-head bolts are preferably used as the removable fasteners.

In one non-limiting example of the metal wet-set REP TWS Unit of the invention, some of the key dimensions are as follows: domes 12*a* may be about 0.9" wide at the base and 0.45" at the top, with a height of 0.2". Dimples 14 (located on both the surface of the inventive unit and the top surface of the domes) are 90 degree truncated cones about 0.040" high, 0.12" wide at the base, and 0.040" wide at the top, and closely spaced together. These add to the slip resistance (the coefficient of friction) of the surface. Body 40*a* is 0.060" thick. The walls of holes 42*a* are at an angle of about 43.5 degrees from the horizontal.

Inventive unit 10*a* is wet-set into fresh concrete as follows: the desired number of inserts (one for each opening 26*a*) are secured to the underside of body 40*a* with an equal number of bolts 50*b*. The assembled unit is then placed down onto the top of fresh concrete, often times in a curb ramp, pedestrian crossing or hazardous vehicular way being constructed. Inventive unit 10*a* is then set into the concrete by pressing down on it until it is set such that its top 28*a* is flush with the top of the surface of the concrete. Weep holes 29 pass through flange or edge 60*a* very close to where edge 60*a* meets body 40*a* to allow air to escape from beneath unit 10*a* as it is installed, in a similar fashion as the slots 16 in the first embodiment described above.

If body 40*a* needs to be removed after the concrete has set, an appropriate tool is used to remove the bolts. Due to the draft or angle of the downwardly projecting portions 42*a* and the edges 60*a* of body 40*a*, body 40*a* can be pried off the concrete surface with a pry bar or the like. A replacement body can then be placed down into the location of the removed body, and bolted to the inserts that remain embedded in the concrete.

With respect to the above description then, it is to be realized that the optimum relationships for the elements of the invention, to include variations in size, materials, shape, form, function and manner of operation, assembly and use, are deemed apparent to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will occur to those skilled in the art, it is not desired to limit the invention to the exact construction and operation shown and described, and accordingly, all suitable modifications and equivalents may be resorted to, falling within the scope of the invention.

What is claimed is:

1. A method of installing a replaceable, wet-set tactile warning surface unit, said unit having an upper surface, a lower surface, and a perimeter flange that is thicker than the rest of the body and extending from the lower surface and having a plurality of spaced slots, the body defining a series of raised projections on its upper surface and defining a plurality of spaced through-holes from the upper to the lower surface, comprising:

installing a plurality of fasteners through the plurality of through-holes;

affixing an anchor member to each of the plurality of fasteners, such that the anchor members are proximate the lower surface of the body; and placing the unit into fresh concrete and applying force to the top of the unit to embed the unit in the concrete such that the unit edges are approximately flush with the top surface of the concrete and the air trapped under the unit escapes through the spaced slots in the perimeter flange.

2. The method of claim 1 further comprising:

replacing the unit by removing the fasteners;

prying the unit off of the surface and leaving the anchor members embedded in the concrete;

providing an essentially identical replacement unit;

placing the replacement unit on the surface such that its through-holes are aligned with the embedded anchor members; and affixing the replacement unit to the concrete by passing fasteners through the through-holes and into the anchor members.

3. A replaceable, wet-set tactile warning surface unit, comprising:

a body defining an upper surface, a lower surface, and a perimeter flange that is thicker than the rest of the body and extending from the lower surface, the body defining a series of raised projections on its upper surface, and defining a plurality of spaced through-holes from the upper to the bottom surface, in which the raised projections are spaced from one another and the through-holes are located between the projections;

an equal plurality of anchor members coupled to the bottom surface of the unit member directly below the through-holes by an equal plurality of fasteners that pass through the through-holes; and a plurality of spaced slots passing through the perimeter flange that allow air to escape from underneath the unit when it is installed in fresh concrete.

4. The replaceable, wet-set tactile warning surface unit of claim 3 in which the perimeter flange defines an inner surface that is tapered such that the bottom of the flange is narrower than the top of the flange where it meets the rest of the body, to facilitate removal of the unit from fully set concrete.

5. The replaceable, wet-set tactile warning surface unit of claim 1 in which the anchor members comprise internally threaded flared metal inserts with flared ribs and an enlarged base.

6. The replaceable, wet-set tactile warning surface unit of claim 1 in which the lower surface of the body surrounding each of the through-holes defines a downwardly-protruding lower projection.

7. The replaceable, wet-set tactile warning surface unit of claim 6 in which the downwardly-protruding lower projections define a tapered, generally truncated conical shape such that the bottom of the projection is narrower than the location at which the projection meets the rest of the body.

8. The replaceable, wet-set tactile warning surface unit of claim 1 in which the body proximate each through-hole is offset downward to define a recess in the upper surface.

9. The replaceable, wet-set tactile warning surface unit of claim 8 in which the fasteners define an enlarged head that is located in a recess, such that the head does not project above the upper surface of the body that surrounds the recess.

10. The replaceable, wet-set tactile warning surface unit of claim 9 further comprising an equal plurality of caps that are fitted into the recesses to cover the heads of the fasteners.

11. The replaceable, wet-set tactile warning surface unit of claim 10 in which the recesses define a shoulder, and the caps sit on the shoulders, are structural, and are essentially watertight.

12. A replaceable, wet-set tactile warning surface unit, comprising:

a body defining an upper surface, a lower surface, and a perimeter flange that is thicker than the rest of the body and extending from the lower surface, the body defining a series of raised projections on its upper surface, and defining a plurality of spaced through-holes from the top to the bottom surface, in which the raised projections are spaced from one another;

an equal plurality of anchor members coupled to the bottom surface of the unit member directly below the through-holes by an equal plurality of fasteners that pass through the through-holes, and a plurality of spaced slots passing through the perimeter flange that allow air to escape from underneath the unit when it is installed in fresh concrete.

13. The replaceable, wet-set tactile warning surface unit of claim 12 in which the lower surface of the body surrounding each of the through-holes defines a downwardly-protruding lower projection.

* * * * *